US006477727B1

(12) United States Patent
Fromme

(10) Patent No.: US 6,477,727 B1
(45) Date of Patent: Nov. 12, 2002

(54) BEARING ELEMENT FOR UPHOLSTERY SUPPORT FOR A SEAT OR BED SYSTEM

(75) Inventor: Heinrich Fromme, Schloss Holte-Stukenbrock (DE)

(73) Assignee: FROLI Kunststoffwerk Heinrich Fromme OHG, Schloss Holte-Stukenbrock (DE)

( * ) Notice: Subject to any disclaimer, the term of this patent is extended or adjusted under 35 U.S.C. 154(b) by 0 days.

(21) Appl. No.: 09/462,960

(22) PCT Filed: Jul. 17, 1998

(86) PCT No.: PCT/EP98/04420

§ 371 (c)(1),
(2), (4) Date: Apr. 17, 2000

(87) PCT Pub. No.: WO99/03379

PCT Pub. Date: Jan. 28, 1999

(30) Foreign Application Priority Data

Jul. 18, 1997 (DE) ..... 297 12 720 U
Jul. 18, 1997 (DE) ..... 297 12 721 U
Dec. 9, 1997 (DE) ..... 297 21 655 U

(51) Int. Cl.[7] ..... A47C 23/057; A47C 23/30

(52) U.S. Cl. ..... 5/247; 5/253; 5/263; 5/255; 5/719; 5/239; 267/81

(58) Field of Search ..... 5/236.1, 239, 245, 5/247, 253, 255, 258, 263, 719; 297/452.49; 267/81, 106, 142, 143

(56) References Cited

U.S. PATENT DOCUMENTS 122,111 A * 12/1871 Duffy ..... 5/255
5,426,799 A * 6/1995 Ottiger et al. ..... 5/719
5,588,165 A * 12/1996 Fromme ..... 5/255
5,632,473 A * 5/1997 Queiroz ..... 5/719
5,787,533 A * 8/1998 Fromme ..... 5/719
6,113,082 A * 9/2000 Fujino ..... 5/719

* cited by examiner

*Primary Examiner*—Michael F. Trettel
(74) *Attorney, Agent, or Firm*—Burns, Doane, Swecker & Mathis, LLP

(57) ABSTRACT

The invention relates to a bearing element having a base plate fitted on a support, for a seat or bed system, with a bearing plate to hold upholstery. The invention seeks to produce a bearing element whose range of spring is approximately equal to the total height, and which is easy to produce. To this end, at least two spring elements serving as bearing arms (12, 22) are fitted between the base plate (11, 21) and the bearing plate (15, 25). These spring elements, configured like leaf springs, are directed outwards from the base plate (11, 21). Their outer ends join the hearing plate (15, 25). In another version of the invention, a spring body (35, 35') is fitted between the base and bearing plate. The spring body head (35.2) and foot (35.1), like the bearing plate and base plate, have corresponding locking parts, so that the bearing plate can also be removably placed on the spring body (15, 15') and on the base plate (21). The invention also seeks to provide a bed system that is fitted with the inventive bearing elements, and which is characterized by its versatility. To this effect, fixing means for bearing elements are fitted on the plate or laths, preferably as undercrosses (30) that can be connected by socket connectors, with fixing means for the bearing element (10, 20) in the crossing area. A second version of the invention is intended in particular for lath frames (2) with mountable frame part(s) (3, 5, 7). In this version, at least one row of bearing elements (30') belonging to the outer mountable frame part is fitted with bearing elements (35') having a foot support (31) and a bearing plate (20, 40, 50). The other rows have bearing elements (30), which comprise a foot support (31), spring body (35, 35') and bearing plate (20, 40, 50).

19 Claims, 16 Drawing Sheets

BEARING ELEMENT FOR UPHOLSTERY SUPPORT FOR A SEAT OR BED SYSTEM

BACKGROUND OF THE INVENTION

The invention relates to a bearing element produced as an injection-moulded part made of an elastomer, which is a bearing element for upholstery in particular for rear-ventilated upholstery supports such as upholstery, mattresses or the like for seat or bed systems.

Upholstery supports serve as supports for upholstery, on which the human body (hereafter referred to as a "body") can be placed in an ergonomically appropriate manner. Such type of upholstery is known from EP 0401 712, where the entire area of the support is covered with elastic elements, which is supported in U-profiles to avoid overloading and to limit the available spring deflection, so that for the placing of seats or bed systems the bearing surface for an upholstery support such as a mattress—as is already known from DE 36 12 603 A1—is divided into subareas, which are arranged in a regular patterns and where each individual one of these spring elements is designed to be spring-loaded.

Upholstery resting on surfaces absorbs body moisture and during a sitting or resting period gets wet, in particular in areas where people are resting in a humid atmosphere for lengthy periods and where the bearing surface is impermeable to moisture—such as for instance in caravans and in boats. To allow rear ventilation, EP 0 653 174 suggests to provide the bearing plate with openings. An unsatisfactory aspect of these proposals is that the height of the individual bearing elements must be (relatively) great, since the available range of spring deflection is only a fraction of the height of the unloaded bearing element.

A frame for seat or bed systems, whose longitudinal and transverse bars are provided with easily mountable spring elements is described in DE 196 37 933 C: where these spring elements have bearing plates on which the mattress or upholstery rests. The spring elements are defined by leaf spring elements in a lying arrangement, which leaf spring elements are almost C-shaped and are arranged mirror-symmetrically to one another in such a manner that the centre of the lower leaf spring is supported on the bar and the upper leaf spring supports the centre of the bearing plate.

GB 2 143 123 (corresponding to U.S. Pat. No. 4,688,893) describes a support for upholstery or the like, which support is movable within itself, and where a number of ring-shaped connecting members are connected with one another by means of clamping bodies. Such a support is stable within itself due to these interconnections and does not require an additional support, however the movability of the support within itself does not permit a force-related supporting adjustment. A different mattress support with an elastic top surface, made up of a plurality of foam rubber blocks is described in DE 196 00 434, which proposes the use of foam rubber blocks of varying degrees of hardness to achieve the hardness adjusted to the respective supported body region. Both these documents do not describe a support consisting of individual bearing elements with at least base and bearing plate.

Finally, DE 295 05 052 U (corresponding to U.S. Pat. No. 5,787,533) describes a bearing element, where a grid is formed of crossing pieces and webs, wherein, onto the crossing pieces and/or the webs, spring bodies are clipped, which spring bodies have bearing plates attached to their heads. In this instance the locking parts have different designs, a mere placing of the bearing plate onto the base is not possible.

It is therefore the object of the present invention to further develop the known bearing elements in such a way that the range of spring deflection consists of a substantial proportion of the total height, whereby with the rear ventilation maintained, the bearing elements are easy and economical to produce and have a wide range of applications; in addition, a bed system with such bearing elements shall be proposed which can be easily and economically produced and is of versatile use.

SUMMARY OF THE INVENTION

In order to achieve the spring action in a first embodiment, at least three or four bearing arms are provided which are directed outwardly from a base, which bearing arms are defined as leaf springs with a spring deflection aimed in the direction of the bearing pressure. Each of these bearing arms is provided with a terminal bearing surface; these bearing surfaces of a bearing element together form the bearing plate holding the upholstery, to which bearing plate they are fastened between the bearing surfaces in the region of bridging connections. When the springs are compressed, the bearing surfaces are forced outwardly. These bearing surfaces are coupled with further spring elements in such a manner that the outward movement loads these further spring elements. In this case, both springs act in the same direction. When the springs of the bearing arms are being loaded by being pressed down, the bearing plates moving outwardly cause a loading of the further spring element, so that ultimately the spring load-deflection curve of the bearing element can be set as required or as desired by the combination of both curves. The deflection of the bearing surfaces being possible down to the base, it is possible to achieve spring deflections which—up to material thickness—corresponds to the height of the bearing element itself.

These bearing arms have a rotationally symmetric arrangement, so that the angular distance of three bearing arms is 120° and that of four bearing arms 90°. When the leaf springs forming the bearing arms are designed in such a way that their spring constants are equal, there results, also in lateral force components, a deflection without the "canting" (known from other upholstery supports) so that a correct upholstery is obtained; it is however obvious that the spring constants are selected independently of this consideration. If, furthermore, by a corresponding design of the bearing surfaces, the bearing plate contains a free inner space, at least of the size of the base area, ranges of spring deflections can be achieved which—apart from the material thickness—correspond to the height of the bearing element itself, so that this deflection can even occur down to the plane of the base. In this case it is advantageous if the bearing arms supplying the spring force are made of a correspondingly high-quality elastomer and the bearing surfaces of an economical plastic material, which plastic parts can be produced by way of the two-component-injection moulding process or in separate production processes.

One advantageous embodiment proposes the use of undulated springs as spring elements in the bearing arms. The stretching of the bearing arms in this case leads to a compression of the undulated spring, resulting in counteracting the change of position of the bearing surface. The coupling spring elements in this embodiment are designed as Omega-type springs between the bearing surfaces which are divided, linking them. In particular the Omega design allows a spring deflection which is not reduced by undulations. By means of these further spring elements these bearing surfaces are coupled in such a manner that the outward movement results in a loading of these further spring elements. Both springs work in the same direction. If the springs of the bearing arms are loaded by downward pressure, the bearing plates moving outwardly cause a loading of the further spring elements so that ultimately the spring load-deflection curve of the bearing elements can be set by means of the combination of both spring load-deflection curves in such a way as is necessary or desirable.

In order to fasten these bearing elements on a support, the base is designed accordingly. If differences in height in the installation are to be adjusted in such a manner that all bearing plates are positioned in a plane, the base is advantageously defamed as a base plate or as a base body of corresponding height. In one embodiment the base plate/the base body is provided with a central hole. The fastening is performed by means of a screw or a dowel pin wherein the screw or dowel pin penetrate into the support. In a similar manner the base plate is provided with two holes or dowels which are diametrically opposite to each other relative to the centre of the base plate. Also in this cast the fastening is achieved by means of screws or dowel pins, the connection thus screwed or doweled is torsionproof due to its hole configuration.

If a T-shaped holder is fastened on the support, the central hole for secure fastening by overlapping of this holder has at least one, preferably however two flattened sides opposite each other. Due to the flattened sides, the T-shaped holder can be fixed to the support: the bearing element is then placed on top and fixed by a rotation of approximately 90°.

In a further embodiment, the base plate has hook-shaped laths: these laths interact with holding elements provided on the support in such a manner that the hook-shaped laths engage with corresponding projections at these holding elements and form a conjugate connection. If these hook-shaped laths are elongated and arranged on both sides of the centre of the base plate, they form one part of a sliding connection the other part of which defines the holding elements provided on the support so that the bearing elements can be slipped onto such holding elements: if the laths are arcuate and arranged diametrically opposite relative to the centre of the base plate, they define part of a twist-lock connection, the other part of which is defined by corresponding holding elements provided on the support. The bearing elements can be fastened to the holding elements in the manner of a bayonet-type twist-look connection. An advantageous design of the laths proposes the provision of stop means to limit the twist-lock or sliding range. Both these arrangements allow the bearing elements to be fixed in a simple and secure manner to the support, wherein the stop means allow for the fixing of the desired positioning.

In a second embodiment, the spring action is achieved by the bearing element having a spring body arranged between a foot mount and a bearing plate, wherein the foot mount has disposed on it one part of the look and the bearing plate the other part of the lock designed as means for the fixable and releasable insertion of the spring body as well as for the releasable attachment of the bearing plate onto the foot plate. The spring body itself has at one end the upper part of the locking means and at the other end the lower part of the locking means and can thus have one of its spring body ends placed on the base plate and its other spring body end attached to the bearing plate; base mount and bearing plate are placed at a greater distance from one another by being spaced apart by the spring body. In this way a spring-loaded bearing element is produced which, when provided with spring bodies of different heights, can be used at different heights and thus facilitate a height adjustment, wherein the height of the spring body determines the height of the bearing surface.

A flat bearing element is solely formed by the combination of a foot mount with a bearing plate placed on a support structure, which arrangement is joined together by means of locking means, advantageously as a bayonet-type twist-lock connection, where projections engage in recesses shaped as circle segments, and which are provided in the central part of the bearing plate and allow for twist-locking. The projections are advantageously defined as mushroom-shaped protrusions engaging in recesses behind the central part. Locking means are provided for this arrangement which interact by latching into place, and which are generally defined as lugs, protrusions or the like as well as corresponding recesses or indentations.

In one embodiment, the spring body between spring body foot and spring body head is defined by two double polygons, with their tips directed towards each other, whose outwardly directed surfaces form the spring body foot and the spring body head. The polygon tips directed towards each other are joined in such a way that they form between them a tube piece of essentially rectangular cross section, which acts as a spring tube and stabilises the polygon spring and, when compressed, forms a bearing with its own spring load-deflection curve. In a further embodiment the spring body is formed by a single polygon. Here the outer sides of the polygon form the foot plate or the spring body head, whilst the surfaces directed laterally outwardly define the tips directed outwardly. The inner side of the spring body head has a tube piece integrally formed with it which—analogous to the tube spring in the double polygons—define a semi-tube spring, which when compressed bears against the inner side of the spring body foot and thus forms a bearing with its own spring load-deflection course.

The bearing plate in one embodiment has at least three or four bearing arms directed outwardly—each one running into an outer bearing surface—and are arranged opposite each other. Furthermore, the bearing plate has an inner bearing surface, supported on the central plate. Radial connectors link the central plate to the outer bearing surfaces, wherein the outer bearing surfaces relative to the height of the inner bearing surfaces are arranged at a higher level. In a further development of this embodiment there are arranged in the bearing arms between each of the outer and inner bearing surfaces intermediate bearing surfaces, which are integrally formed with the radial connectors at a higher level than the inner bearing surface, but at a lower level than the outer bearing surfaces which are arranged at an inclined position. This stepped height variation results in an essential reduction of the contact area of the underside of the mattress or the like. The bearing surface is advantageously reinforced with bent off edge regions with C-shaped or U-shaped cross section of at least the outer bearing surfaces.

In order to adjust the deflection of the stepped bearing surfaces to the requirements, the radial connectors are defined as bridging elements linking the individual bearing surfaces, the rigidity of which bridging elements determines the necessary force required for the deflection. To adjust these forces to the requirements, these bridging elements are adjusted in width and thickness. In a preferred embodiment, these bridging elements are designed as spring members, wherein the spring members are preferably equipped with undulated springs as spring elements. The spring elements are adjustable to the desired or required force ratio by an appropriate design. In this design the ventilation is considerably improved, wherein it is advantageous, if independent therefrom the radial connectors and/or the bearing surfaces are provided with ventilation openings; in addition an improved accommodation of the physiological sleeping position is thereby achieved.

The one embodiment has three or four bearing arms at angular distances of 120° or 90°: when several bearing elements are assembled with beaming plates into one upholstery support, these bearing arms of adjacent bearing plates can be positioned in such a manner that an (almost) continuous bearing surface is provided, in particular when the bearing arms are shaped accordingly. In three-arm bearing plates, the bearing plates are placed at a "turned over" arrangement, so that in each case two bearing arms of the one bearing plate engage with a bearing arm of the adjacent bearing arm. When four bearing arms are used, these are positioned advantageously on a grid as support structure, in such a manner that the lath is "inclined" relative to the crossed bearing arms.

In an advantageous further development there are between the bearing surfaces of adjacent bearing arms connecting arches provided as coupling means; all bearing surfaces together with the coupling means form a closed structure. These coupling means ensure that the individual bearing surfaces cannot be moved independently from another, but that the movement of one bearing surface transfers to adjacent bearing surfaces. Advantageously, the coupling elements are defined as springs which for instance can be OMEGA-shaped flat springs or undulated springs. In the OMEGA-shaped design the opening of the OMEGA is directed outwardly and both its feet are connected with the two bearing surfaces of adjacent bearing plates. To be able to cancel the rigidity, the bent off edge regions of the outer bearing surfaces are interrupted in the region of the coupling elements. With the design of these springs, the degree of coupling is adjustable in such a way that the desired spring properties are maintained.

In a further, also advantageous, embodiment, the bearing plates are closed to form a ring. Also in this case the bearing surfaces are stepped, wherein each outer bearing surface compared with the inner bearing surface/s is at a higher level relative to the upper side of the head part from the foot part. The ring-shaped bearing surfaces are connected with each other via radial connectors, wherein these are formed in angular position. Radial connectors and/or bearing surfaces can be provided with recesses in order to improve the ventilation even further. Advantageously two ring-shaped, closed, stepped bearing surfaces connected with each other via radial connectors are provided; in a further development three ring-shaped, closed bearing surfaces connected with each other via radial connectors are provided. The form of the zing shaped bearing surfaces is circular or—alternatively—square.

In a preferred embodiment, the bearing element is a plastic injection moulded part. The bearing element of this embodiment is simple to produce, the costs for the injection moulding tool because of the large quantity of the bearing elements do not lead to a noticeable cost increase of the individual piece. It is understood that for the production of such bearing elements with regard to their durability against mechanical loads or chemical effects high quality plastics must be used which have sufficient durability. Plastics preferably used are thermoplastic elastomers.

In order to produce a bed system with these bearing elements, these bearing elements are placed on a plate or are fixed to a lath, wherein corresponding fastening means to fasten the bearing elements are provided. In one embodiment a grid support made from intersecting support structure elements (undercrosses) is placed on the plate with fastening means for the bearing elements at the intersections. The individual undercrosses, whose number corresponds to that of the bearing elements, can be joined together by means of socket connectors.

In one embodiment, the bearing element is fixed to a plate, to a grid support placed on the plate or to a lath by means of bonding or welding; in a further embodiment by means of screws (alternatively nails or tacks) or by dowel pins. In another embodiment, the bearing element is fixed to the plate, to the grid support placed on the plate or to the laths by means of plugging into a plug-in connection or by twist locking into a twist-locking connection, wherein the latter is provided on the plate, on the grid support placed on the plate or to the lath in such number which corresponds to the number of the bearing elements provided in the top surface.

The second embodiment of a bed system, equipped with such bearing elements, besides the resolution of the top surface also has steps in the deflection, so that a greater upholstery comfort can be expected, since the bearing elements in accordance with the invention have varying heights. Thereby zones of varying deflection can be formed in a surprisingly simple manner in such a way that in the zone of minor loading—for instance in the area of the head, lower leg/foot—bearing elements without spring bodies between foot support and bearing plate are provided, wherein here the laths are set "high" by means of the known stepped dowel. In the zone of increased loading—for instance in the region of the thighs, pelvis, trunk—by contrast bearing arms with spring bodies arranged between foot mount and bearing plate, and in this arrangement the laths are set "low" by means of the stepped dowels.

In this way, zones of differing firmness result transverse to the extension of the laths, which compensate for the differing loads in these zones. However, also within the zone region of a lath, skewness does not occur, the lath ends are at the same height, the deflections result at certain points due to the individual bearing elements. Advantageously, at least two zones are provided, one zone with bearing elements which are formed of base plate and bearing plate and one zone with bearing elements, formed of foot support, bearing body and bearing plate, wherein by means of stepped dowels, which allow a high and a low position, the first zone is arranged at the frame in a higher position and the second zone in a lower position. In these arrangements, the second zone with bearing elements with spring bodies is essentially provided in the centre of the grid, corresponding to the position of the buttocks of a reclining occupant. At either side of this second zone, a first zone with bearing elements without spring bodies is provided.

Advantageously, the frame is provided with a hinged frame part, the frame having hinges opposite each other. This allows at least one frame part to be elevated; in a further development also the second frame part is designed to be elevated. It is further advantageous to hinge a further frame part onto the elevatable frame part, which again is equipped with at least two laths with bearing elements. This frame part in a grid for a bed defines a head rest, for instance to facilitate reading. Each of the frame parts which can be elevated in relation of the base frame has furthermore at least two rows of bearing elements. Here at least one row of the bearing elements of the outermost of the elevatable frame parts have bearing elements, formed of foot support and bearing plate, whilst the other rows are provided with bearing elements, formed of foot support, spring body and bearing plate. The lower parts and/or the bearing plates and/or the spring bodies of the two embodiments are advantageously made of plastic injection-moulded parts and can also be economically produced in large quantities.

BRIEF DESCRIPTION OF THE DRAWING

The essence of the invention is explained in more detail by reference to the embodiment examples shown in FIGS. 1 to 16. Shown are in:

FIG. 1*a*: Perspective top view, part section.

FIG. 1*b*: Section. Bearing element with base plate.

FIG. 1*c*: Section. Bearing element with base body.

FIG. 2*a*: perspective top view, section.

FIG. 2*b*: perspective section.

FIG. 6*a*: Top view.

FIG. 6*b*: Section.

FIG. 7*a*: Section.

FIG. 7*b*: Detail support structure (undercrosses).

FIG. 8*a*: Top view.

FIG. 8*b*: Side view, section.

FIG. 8*c*: with spring body. Side view. Section.

FIG. 9*a*: Spring body with support strap.

FIG. 9*b*: Spring body with circular arc recess.

FIG. 10*a*: Spring body with double polygon. Side view.

FIG. 10*b*: Spring body with single polygon. Side view.

FIG. 10*c*: Spring body foot. Top view.

FIG. 10*d*: Spring body head. Top view.

FIG. 11*a*: Top view.

FIG. 11*b*: Side view (Frame parts elevated).

FIG. 12*a*: Lath set low, high bearing elements.

FIG. 12*b*: Lath set high, low bearing elements.

FIG. 13*a*: Top view.

FIG. 13*b*: Cross Section.

FIG. 14*a*: Top view.

FIG. 14*b*: Cross section.

FIG. 15*a*: Top view.

FIG. 15*b*: Cross section.

DETAILED DESCRIPTION OF PREFERRED EMBODIMENTS

Figure 1A:
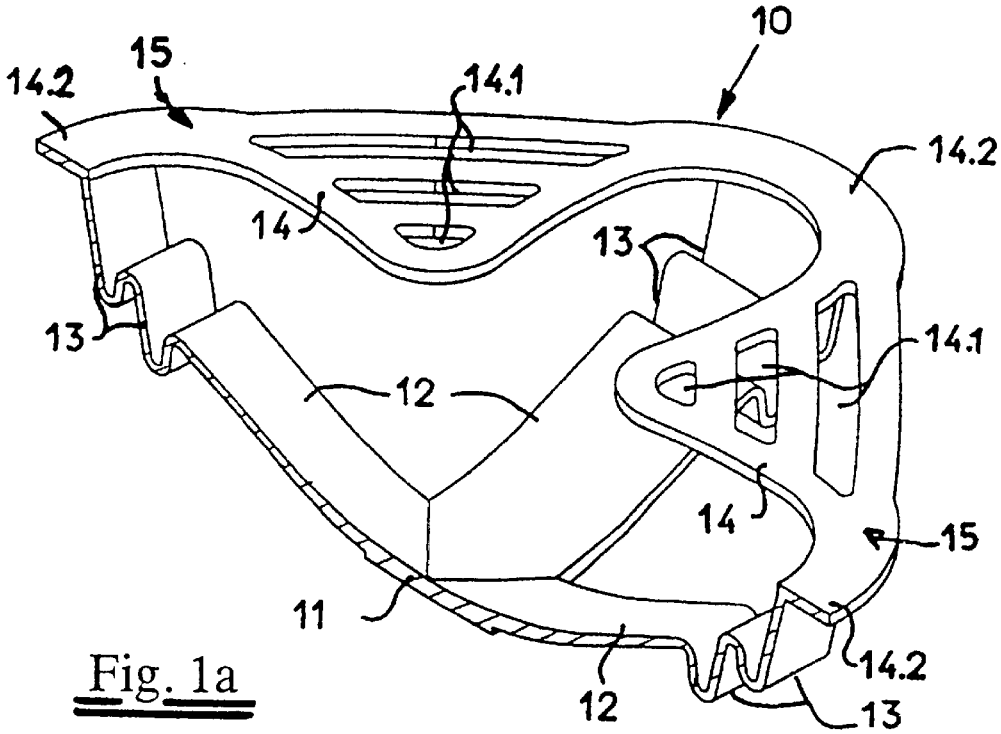
FIG. 1*a*–1*c*: Bearing element with four leaf springs, originating from a base plate, with bearing.
Figure 1B:
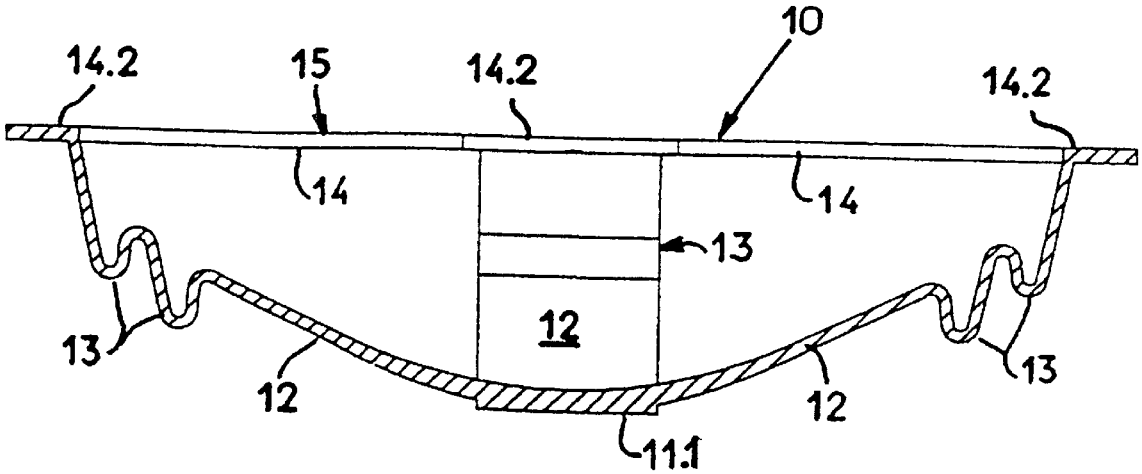
Figure 1C:
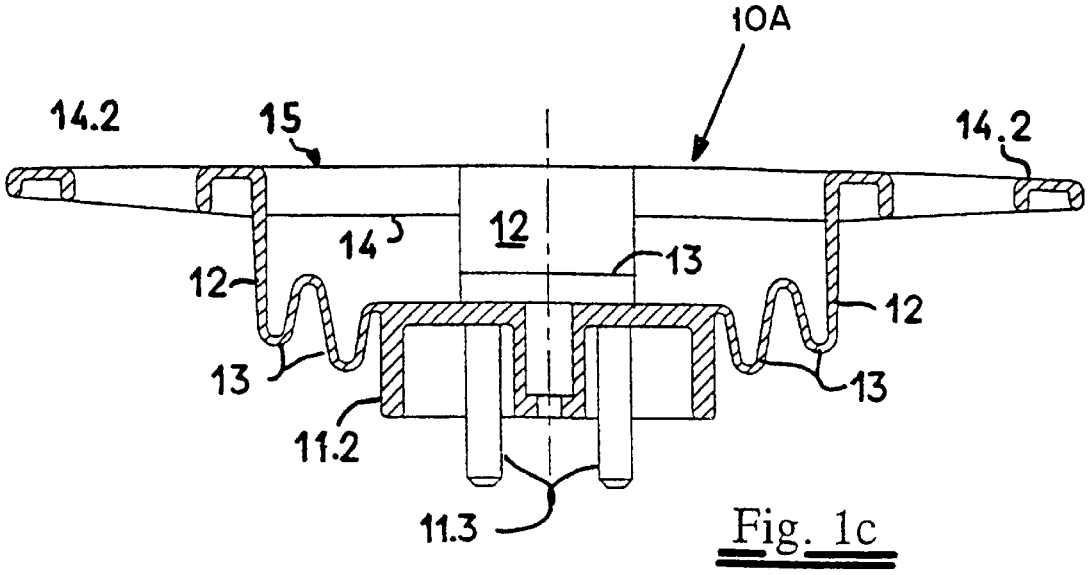
Figure 7B:
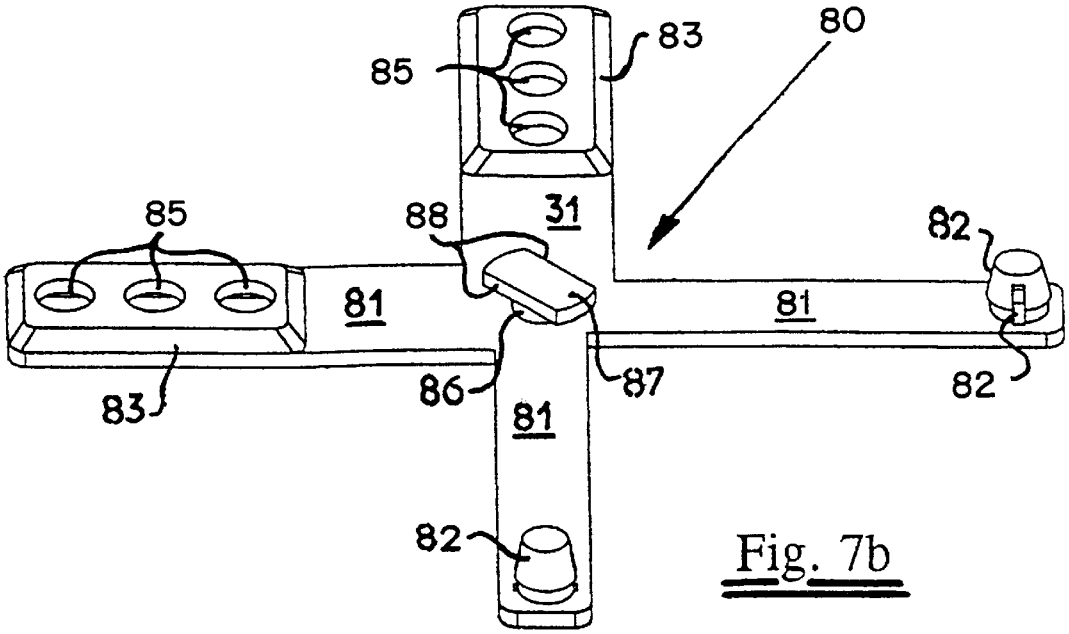
FIG. 7*a*–7*b*: Support structure comprised of intersecting support structure elements (undercrosses) with bearing elements disposed thereon.

The bearing element 10 shown in FIGS. 1*a*–1*c*, has a central base 11, which can be placed on a support (not shown in detail) and can be fixed on this support: this base in this arrangement is defined as a base plate 11.1 (FIG. 1*b*) or—to compensate for the height differences, it may be alternatively shaped as a base body 11.2 as shown in connection with the load-bearing element 10*a* of FIG. 1*c*. To this base plate 11.1 or the base body 11.2, curved leaf springs are connected as bearing arms 12, to the free ends of which the bearing surfaces 14 defining the bearing plate 15 are provided. To compensate for the lengthening resulting from the compression of the bearing arms 12, undulated spring elements 13 are provided, which are capable of accommodating the lengthening resulting from stretching due to the compression of the bearing arms 12 being forced together. The free ends of the bearing arms 12 with the undulated spring elements 13 are connected to bridging elements 14.2 of the bearing plates 15, which join the individual bearing surfaces 14 defining the bearing plate 15 to one closed ring on which rests an upholstery, for instance a mattress.

For the purpose of better ventilation, the bearing surfaces 14 are provided with openings 14.1. The bearing plates 15 created in this way offer sufficient open surface that an upholstery support placed thereon is sufficiently ventilated for the purpose of moisture removal. In this embodiment the bearing plate 15 can be vertically lowered so that canting and the like does not occur. In this arrangement the bearing plate 15 can be stiffened by bending off the outer and the inner edges (similar to the bending off in the bearing element 20, as shown in FIGS. 2*a*, 2*b*, 3, 4 and 5.

Figure 2A:
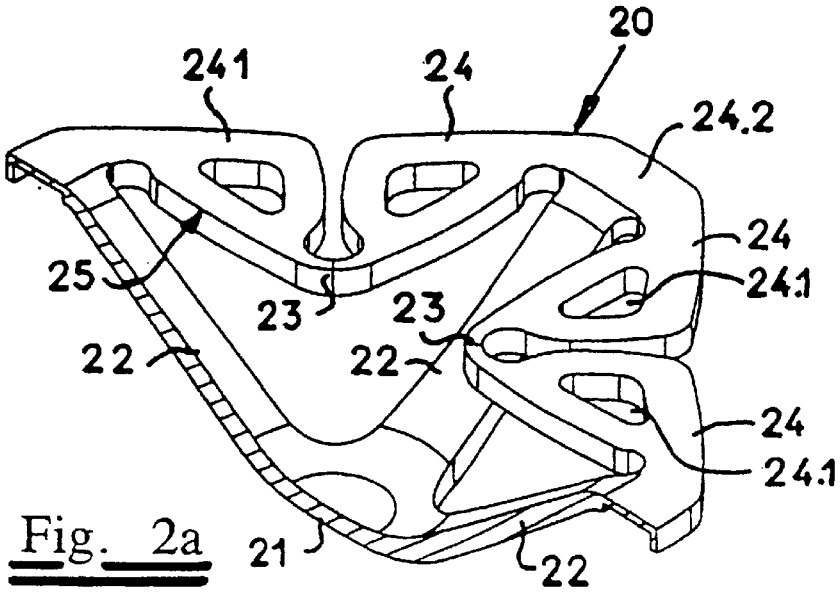
FIG. 2*a*–2*b*: Bearing element with four leaf springs, originating from a base plate, with bearing with bearing surfaces linked via coupling springs.
Figure 2B:
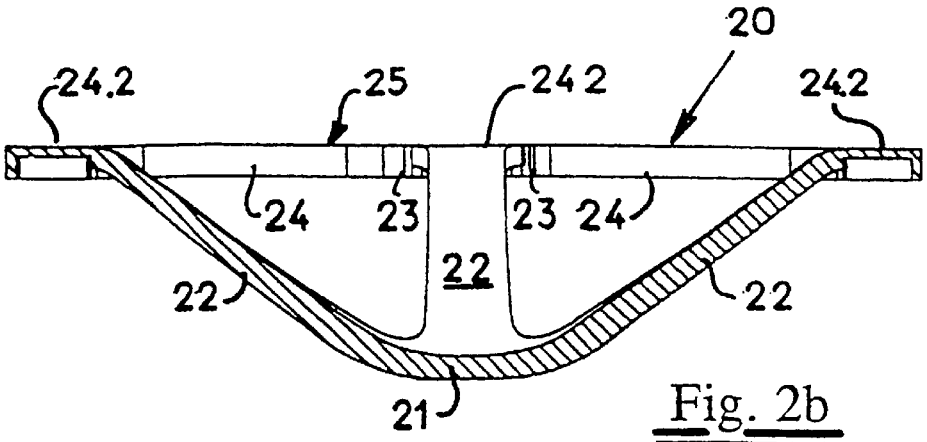

The bearing element 20 shown in FIGS. 2*a*–2*b* has—as does the bearing element 10 (shown in FIGS. 1*a*–1*c*)—a base plate 21 (or alternatively—as described above—a base body), to be placed on and fastened to a support (not shown in detail). Attached to this base plate 21 are also in this arrangement four bearing arms 22 defined as leaf springs, which project towards the bearing plate 25 in a curved manner and, in the region between two bearing surfaces 24, are connected with these surfaces 24 via the bridging elements 24.2. To compensate for the lengthening which occurs during the compressing of the bearing arms 22, Omega-shaped spring connectors 23 are provided, which connect the bearing surfaces 24 defining the bearing plates and which bearing surfaces are divided in this instance. During the compression, the divided bearing surfaces 24 are forced apart so that the OMEGA-shaped spring connectors 23 are loaded.

Also in this embodiment, the bearing plate 25 forms a ring with bearing surfaces 24 projected towards the inside, which bearing surfaces 24, which are connected to each other by way of OMEGA-shaped spring connectors 23, wherein also in this instance openings 24.1 are provided for improving the rear ventilation of an upholstery support. To improve the stability of the bearing plate 25 at least the outer edges including the connecting bridging elements 24.2, advantageously also the inner edges of the bearing plate, and the edges of the opening 24.1 are bent off (as can be clearly seen in FIGS. 5, 6*a* or 6*b*).

Figure 4:
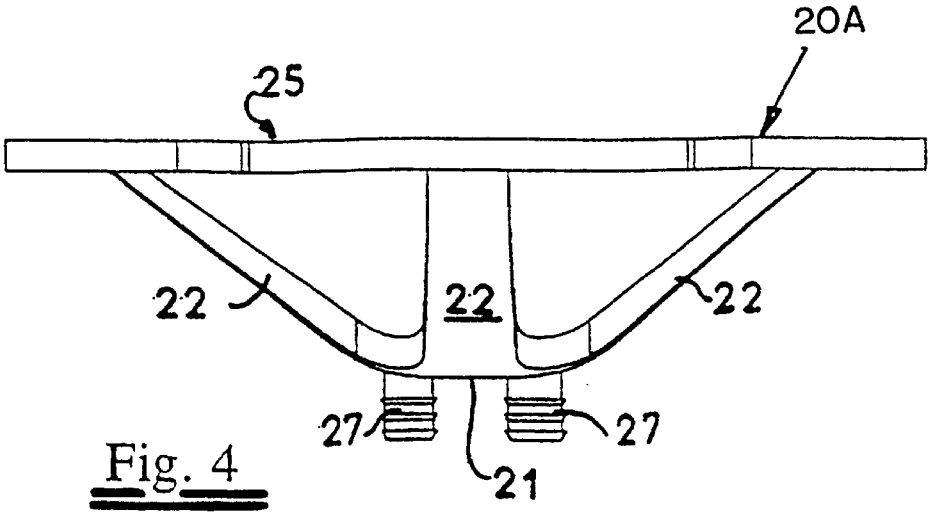
FIG. 04: Bearing element to be fastened by dowel pins. Side view.
Figure 3:
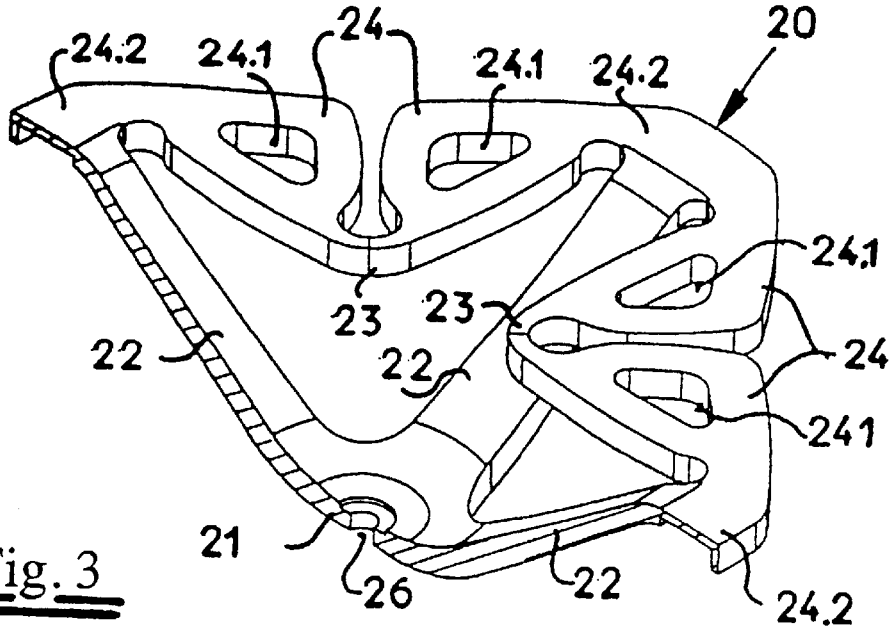
FIG. 03: Bearing element to be fastened by screws, perspective top view, section.
Figure 5:
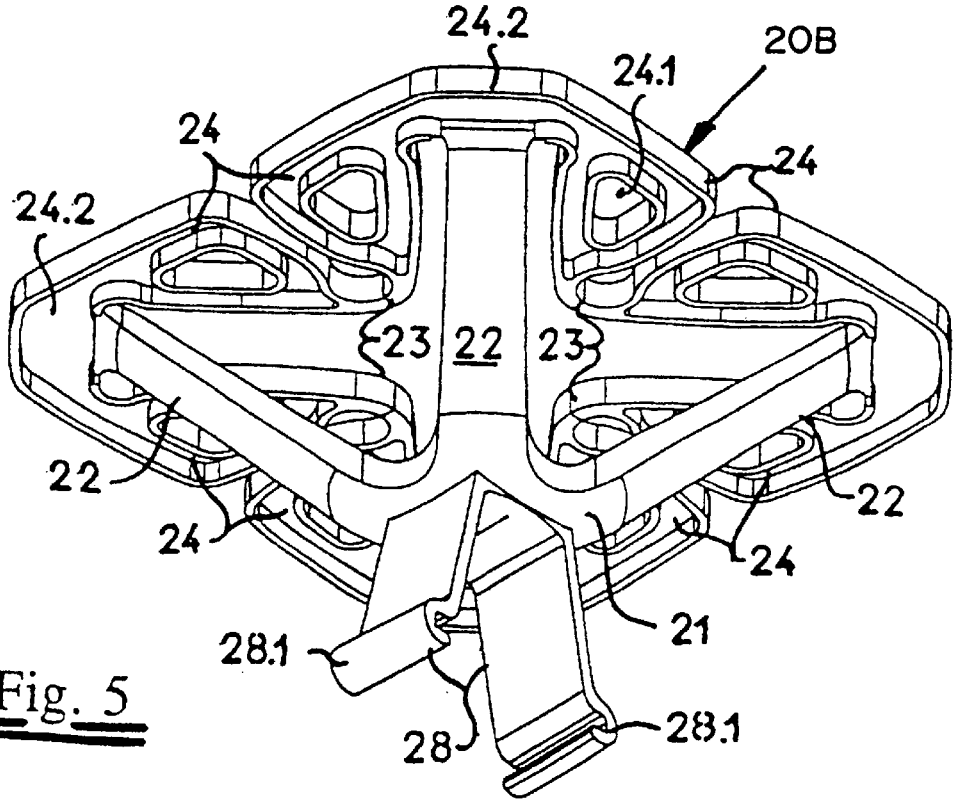
FIG. 05: Bearing element for clamping, perspective underside view.
Figure 6A:
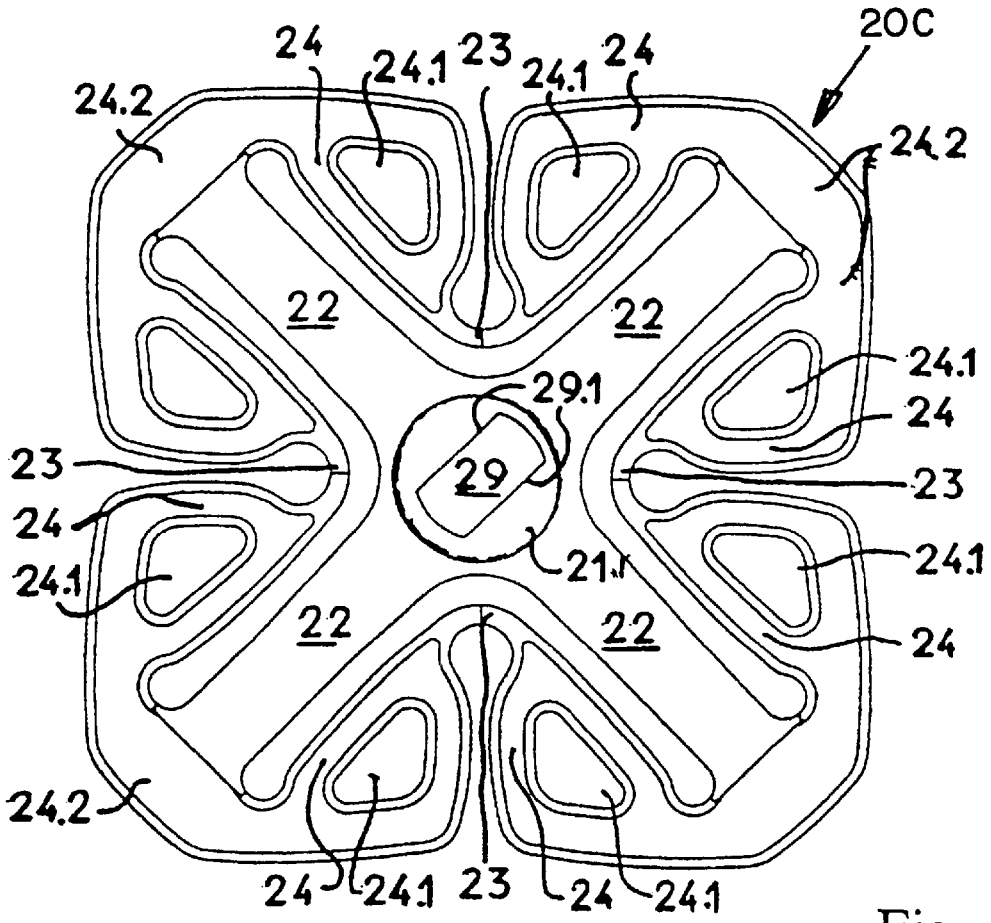
FIG. 6*a*–6*b*: Bearing element with twist-locking connection.
Figure 6B:
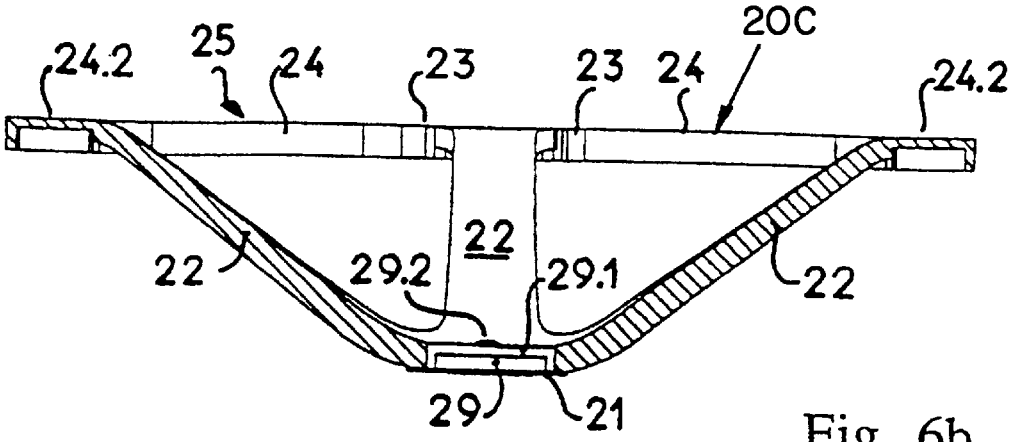
Figure 7A:
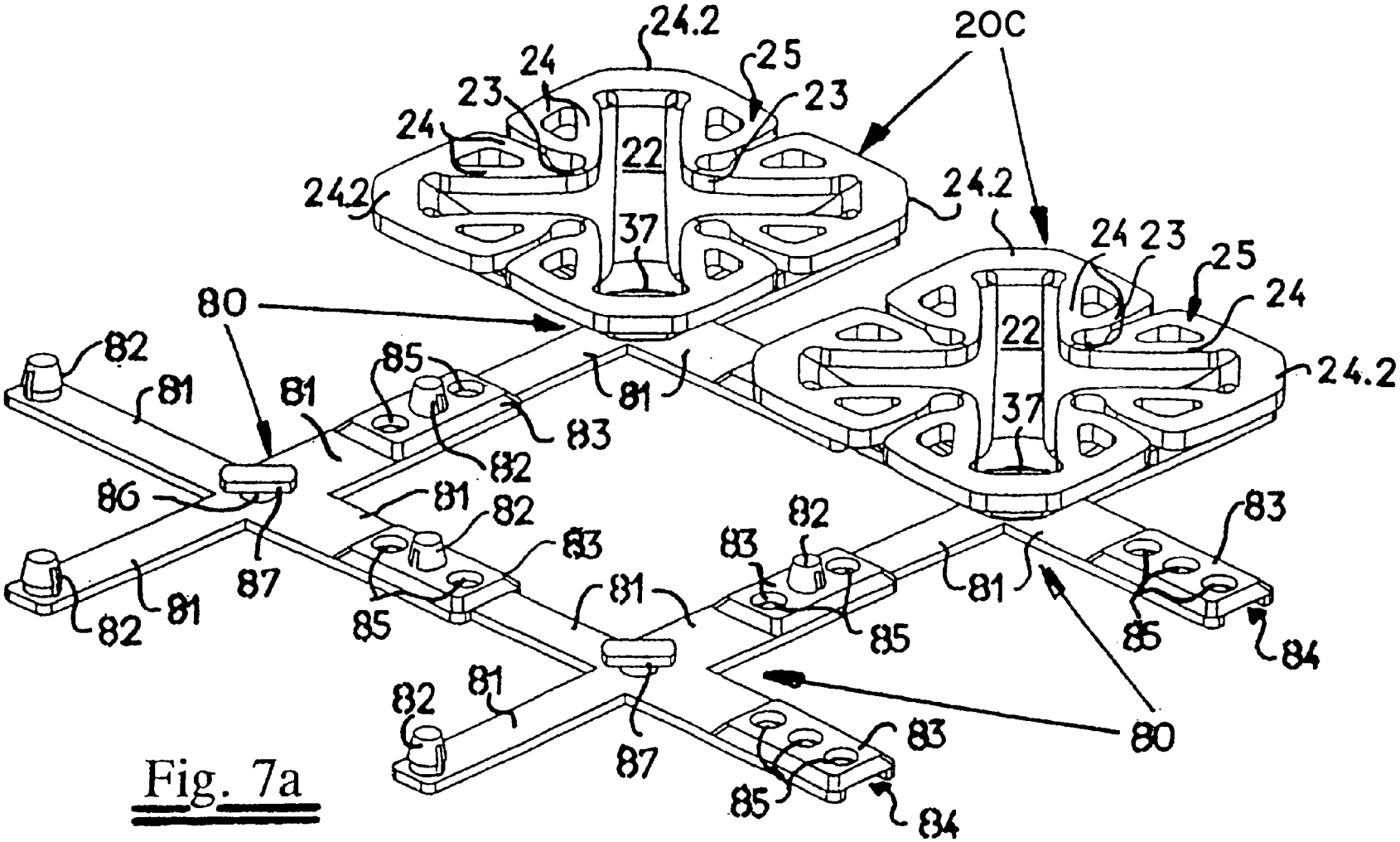

Whilst the bearing elements 10 or 20 of FIG. 1*c* and 2*a*–2*b* can be fastened by nailing, stapling, bonding or the like, to any type of support (not shown in detail), FIGS. 3 to 5 by reference to the bearing elements 20 (the same also applies obviously to the bearing elements 10 as per FIGS. 1*c*–1*c*) show different fastening methods. In FIG. 3 the base plate 21 has a central hole 26 to receive a screw or a dowel pin (not shown): naturally, also two (or more) screws or dowel pins can be provided, for instance for a torsion-proof fastening. The bearing element 20*a* in FIG. 4 shows a base plate 21, with dowel pin 27 on the underside, by means of which the bearing element 20*a* can be inserted into corresponding bores in the support (not shown), wherein the two dowel pins provide a torsion-proof fastening. Finally, FIG. 5 shows a clamp fastening for a load-bearing element 20*b*, where a clamp 28 is attached to the underside of the base plate 21, which overlaps the laths of a normal grid (as shown in this instance), corresponding laths, wherein also other holding means interacting with the clamp are possible.

FIGS. 6*a*, 6*b*, 7*a*, 7*b* show a type of fastening of bearing elements 20*c* on any type of support, formed by intersecting support structure elements (undercrosses) 80, which can be joined together in a level support not necessarily of rectangular shape. To form this level surface, the webs 81 of adjacent undercrosses are joined up. Towards this end, two of the webs 81 have integrally formed dowel-like lugs 82, whilst the other two webs 81 from the underside are provided with recesses and at the upper side with an integrally formed projection 83 provided with holes 85. The recesses 84 are designed in such a way that they are able to accommodate the webs 81 with the lugs 82, whereby these lugs 82 inserted through the holes 85 secure the position of the undercrosses 80 to one another. In this instance several holes 85 in the projections 83 ensure that varying distances can be set between the individual undercrosses 80. To facilitate the joining up, the lugs 82 are provided with grooves 82.1, which enable the use of even (relatively) rigid plastic materials for the undercrosses 80. In the crossing region of the undercrosses 80 fastening means in the form of a twist-lock plate 87 arranged on a pin 86 are provided.

For the interaction of these undercrosses 80, the base plates 21 of the bearing elements 20*c* are in this instance provided with central twist-lock openings 29, through which the twist-lock plate 87 is led. The flattened edges 29.1 of the central twist-lock openings 29 after a rotation of for instance 90° engage the twist-lock plate 87 from behind. Stop means—in FIG. 6*b* recognisable as projection 29.2, which interacts with a corresponding stop projection at the underside of the twist-lock plate 87—ensure that a position secured by twist-locking is retained against reversal.

Figure 8A:
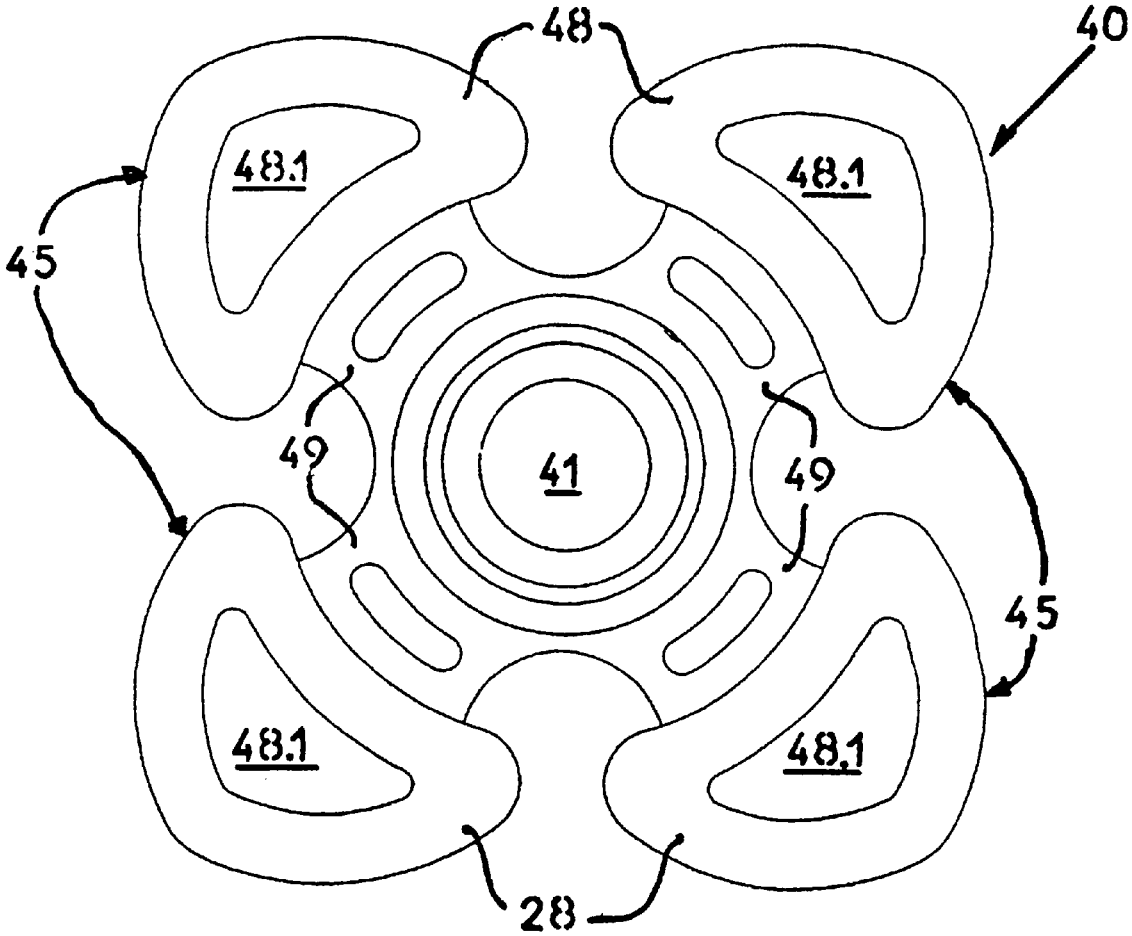
FIG. 8*a*–8*c*: Bearing element with bearing plate.
Figure 8B:
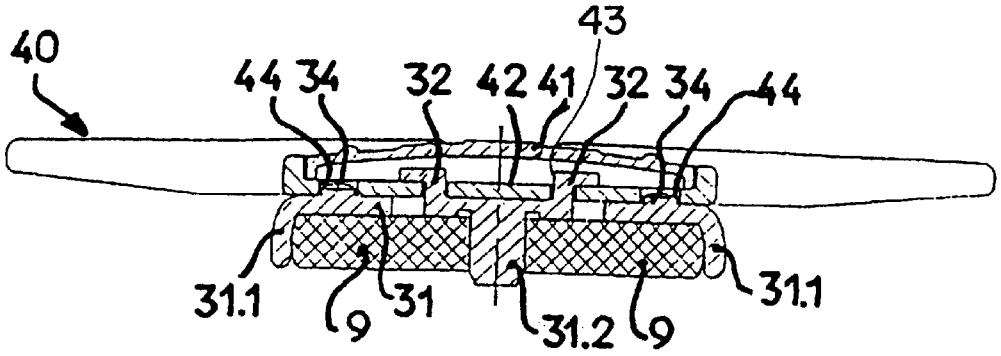
Figure 8C:
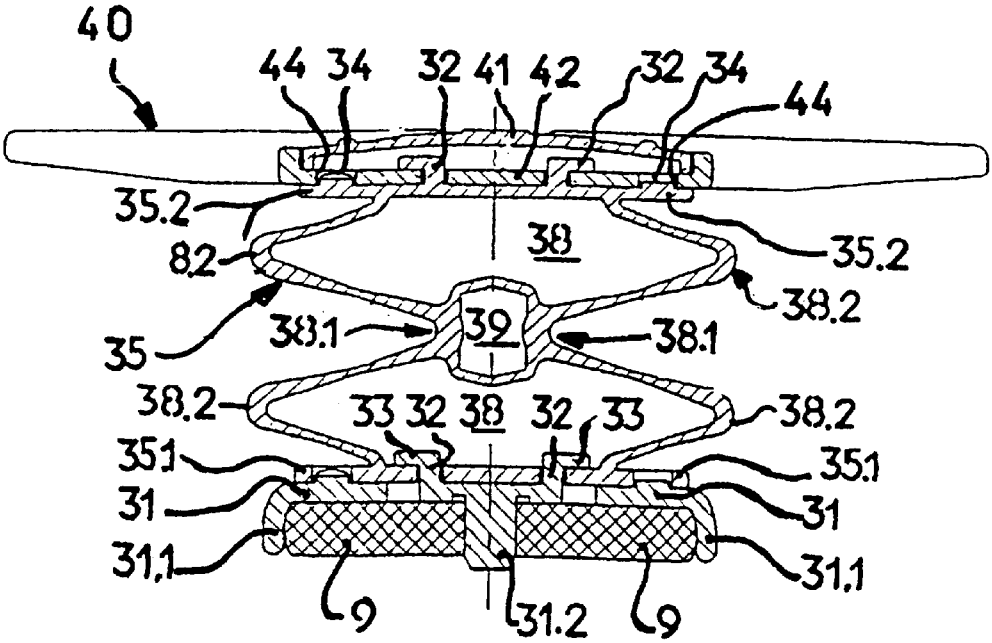
Figure 9A:
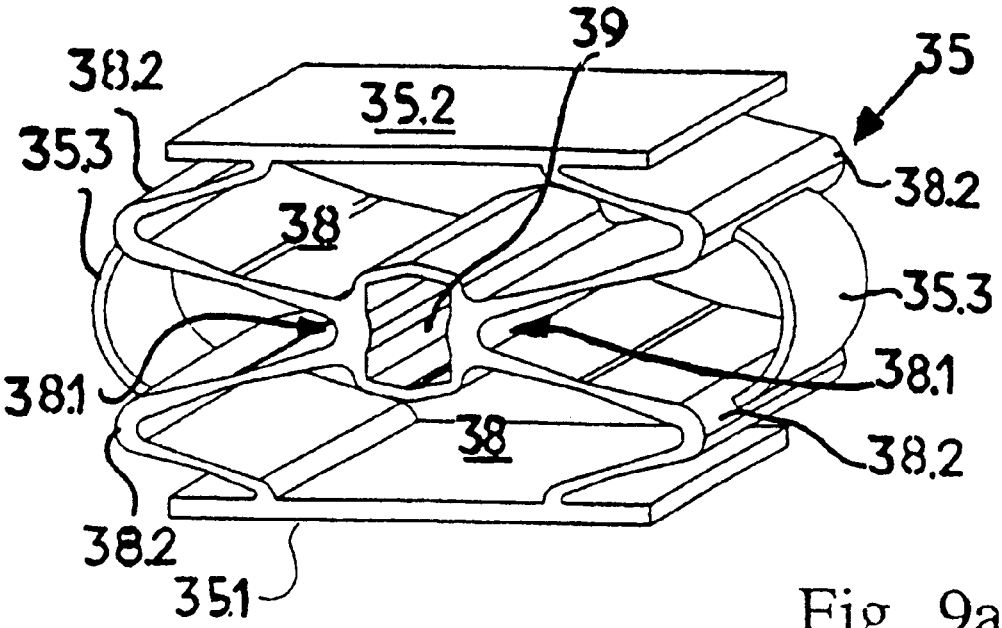
FIG. 9*a*–9*b*: Spring body. Schematic perspective.
Figure 9B:
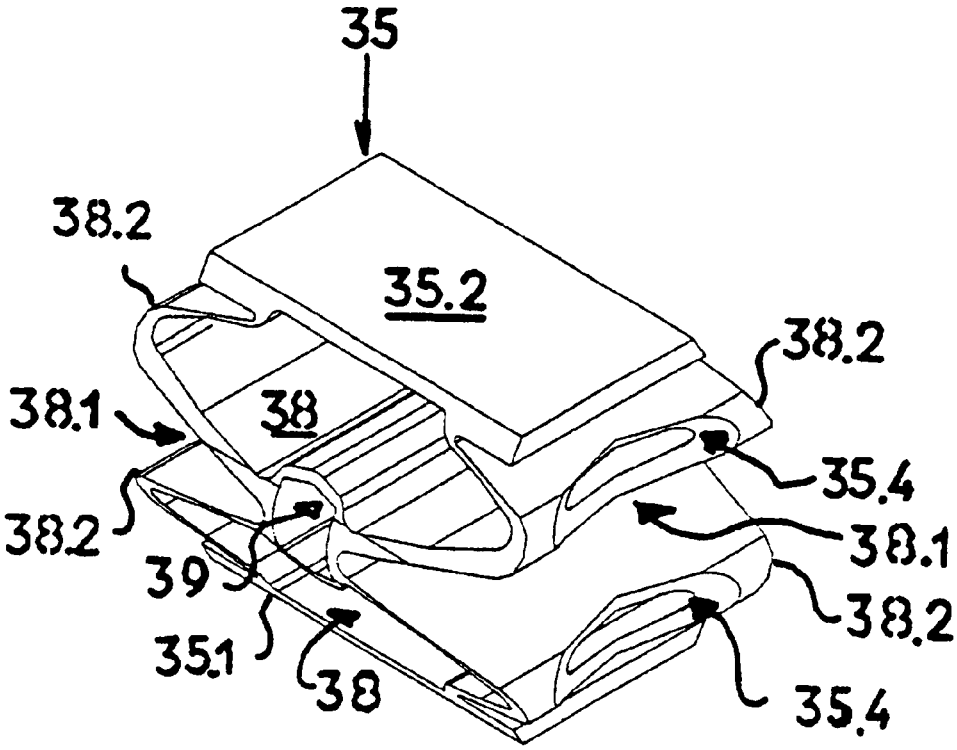

FIGS. 8*a*–8*c* show a bearing element 40 in top view (FIG. 8*a*) which has four bearing arms 45, on which a mattress (not shown) is placed and by which it is supported; these bearing arms 45 have bearing surfaces 48 with recesses 48.1 for rear ventilation, so that an air exchange is possible through surfaces which are closed within themselves. Advantageously, also the central plate 41 forms the inner bearing surface, and further bearing surfaces can be provided between the central plate and the outer bearing surface 48, wherein outwardly extending bridging elements 49 connect the central plate 41 with the bearing surfaces 48. In this arrangement each bearing surface is advantageously spaced at a greater height than the preceding one so that the outermost bearing surface 48 compared with the (inwardly) following bearing surfaces is placed at the highest position, etc. down to the innermost bearing surface which in this sense has the lowest position. The unloaded mattress thus only rests on the outermost of the bearing surfaces 48 and has therefore good rear ventilation. With increased loading, the bearing surfaces positioned further towards the interior will be brought into play until, at maximum loading, the mattress is in full contact with all its bearing surfaces.

A section through this bearing element 40 is shown in FIGS. 8*b* and 8*c*. On one hand the bearing plate 40 is placed directly on the base plate 31 (FIG. 8*b*) positioned on lath 9, and on the other hand, for greater spring deflection, a spring body 35 is placed between foot support 31 and bearing element 40 (FIG. 8*c*). In addition, the foot support 31 has two circle segments 32, provided with overhangs 33, which define one part of a twist-lock connection, as well as two diametrically opposite projections 37. For the purpose of positioning onto the support, for instance a lath 9 of a grid 1, the foot support 31, on the side turned away from the twist-lock connection, is provided with a bearing shell 31.1 engaging the lath 9 in a form-fitting manner. A pin 31.2 engaging the bore 9.1 of the lath 9 secures the position of the bearing element 40.

The bearing element 40 has a supporting plate 42, in which are provided two circle segment-shaped recesses 43 defining the corresponding further (second) part of the twist-lock bayonet catch. The circle segments 32 are inserted into these recesses 43 when the foot support 31 and the bearing plate 40 are to be connected. By rotating the bearing plate 40, the overhangs 33 engage the edges of the recesses 43 from behind, so that a fixed connection is achieved. Furthermore, in the supporting plate 42, recesses 44 are provided; projections 34 of the foot support 31 engage these recesses 44 so that a reversed twisting can only occur by overcoming the locking force of the locking connection formed in this manner. The spring body 35 is designed in such a way that it can be inserted between foot support 31 and bearing element 40. The spring body head 35.2 is correspondingly provided with circle segments 32 (see FIG. 10*a*), which can interact with the recesses 43, so that the bearing plate 40 can be placed on top of a high spring body 35 or a low spring body 35' (see FIG. 10*b*).

Figure 10D:
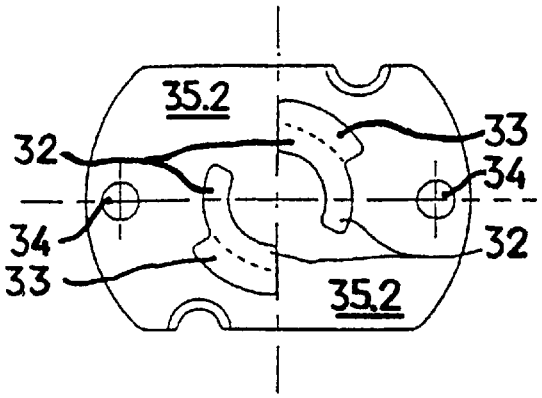
FIG. 10*a*–10*d*: Detail spring body.
Figure 10A:
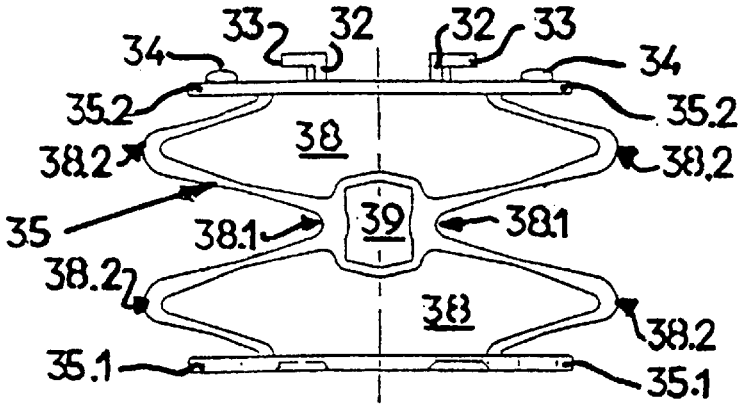

FIGS. 9*a*, 9*b* and 10*a*–10*d* show spring bodies 35 or 35' in a schematic perspective or in side view. A high spring body 35—as shown in FIG. 10*a*—is defined by a double polygon 38, whose sides turned away from one another are defined by the spring body foot 35.1 or the spring body head 35.2; the tips 38.1 of the polygons 38 which are directed towards one another are deformed into a spring tube 39.

Figure 10B:
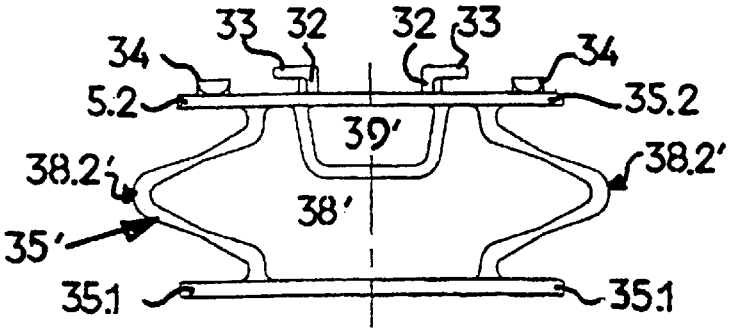
Figure 10C:
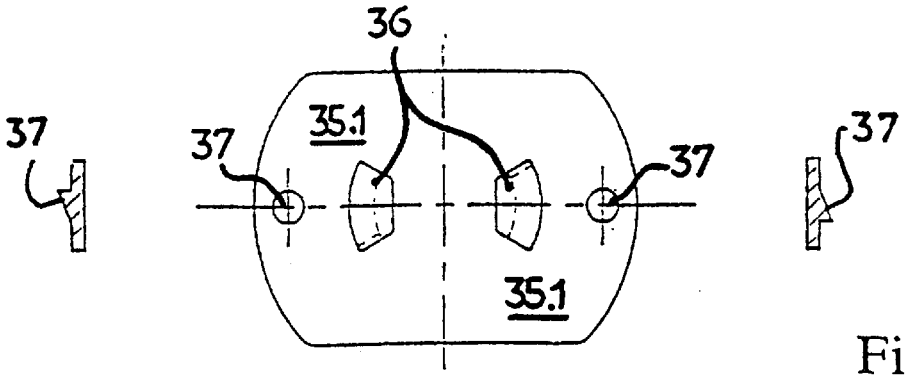
Figure 11A:
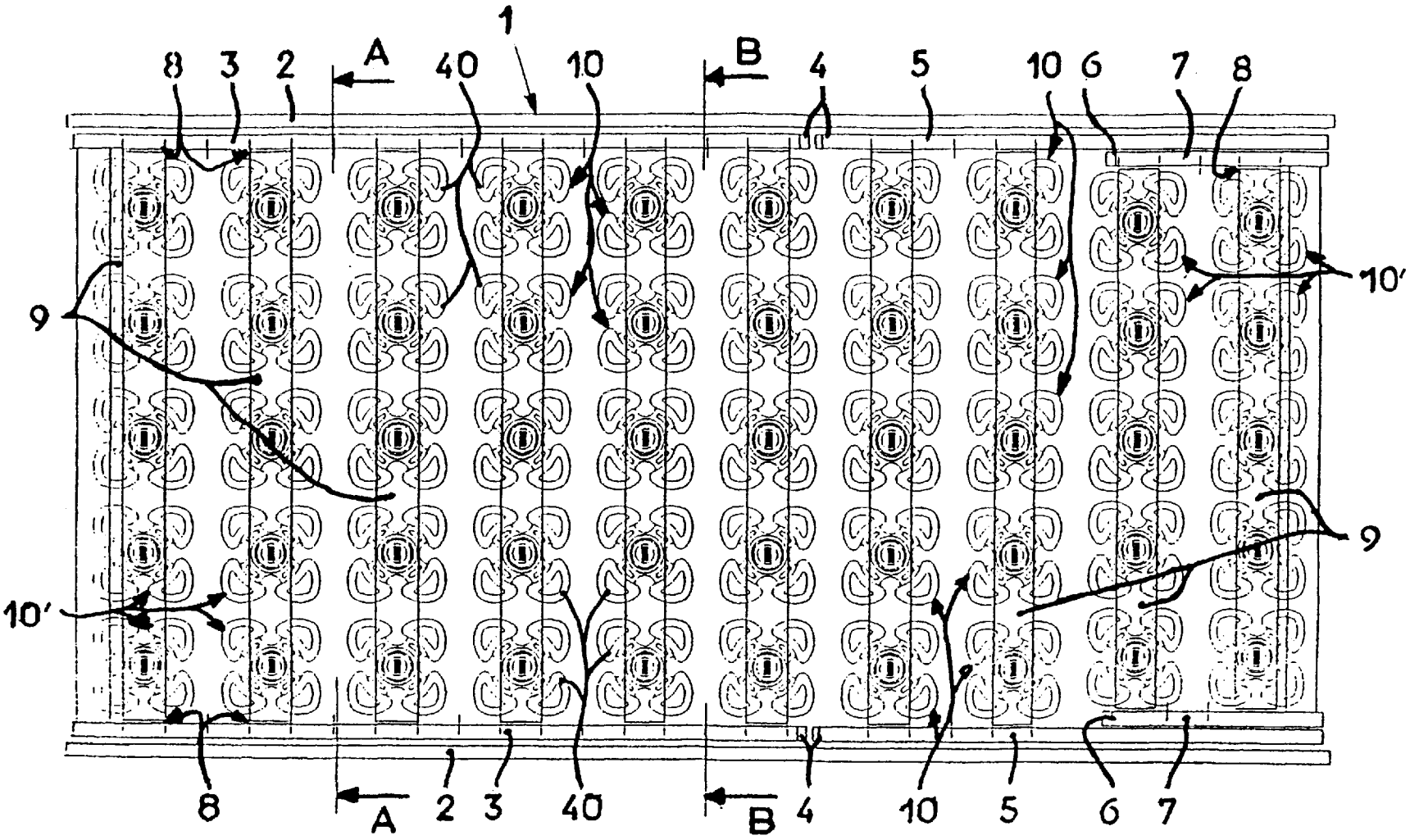
FIG. 11*a*–11*b*: Bed system with grid.
Figure 11B:
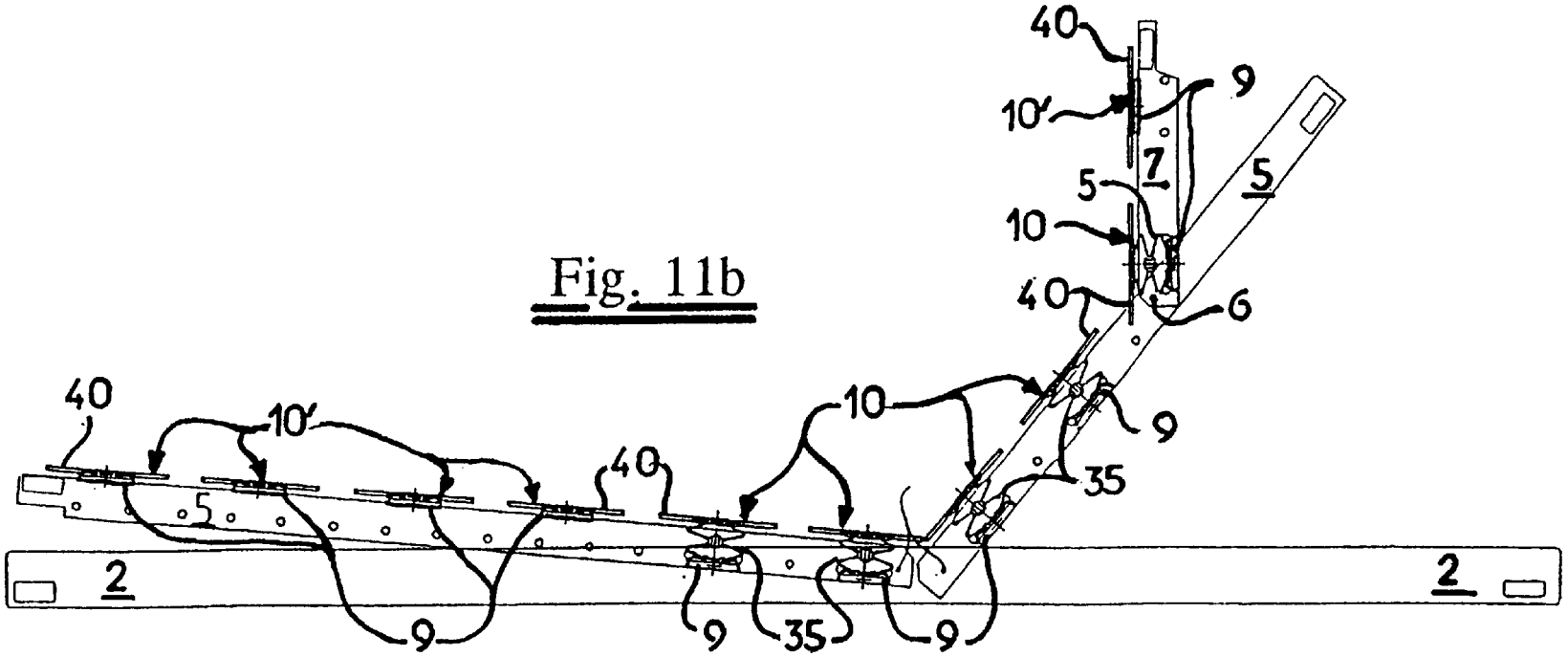

For a bearing element of medium height—FIG. 10*b*—a spring body 35' is provided, whose spring element is defined as a single polygon 38'. In this arrangement, the tube spring 39 is deformed into a semi-tube spring 39' moulded onto the interior side of the head plate. Both spring elements 35 or 35' have the same spring body foot 35.1 and the same spring body head 35.2, so that this spring body 35'—as described above—can be inserted between foot support 31 and bearing plates 40, 50 or 60. The spring body feet 35.1, of equal design, of both spring bodies 35 or 35' (FIG. 10*c*) have—analogously to the supporting plate 42 of the bearing plate 40—circle segment-shaped recesses 36 as well as protrusions 37, which define the one part of a twist-lock catch—as described above—so that the spring body 35 as well as the spring body 35', analogous to the bearing plate 40, can be fixed at the foot support 31. The protrusions 37, after twisting, engage recesses 34 and thus secure the spring body 35 against a reversed twisting and thus against release. The spring body head 35.2 (FIG. 10*d*) is—analogous to foot support 31—equipped with two circle segments 32 provided with overhangs 33 forming one part of a twist-lock catch, which interact with the recesses 43 of the supporting plate 42 as a twist-lock catch, wherein the spring body head 35.2 has protrusions 37, which lock into the recesses 44 and thus—in the above described manner—prevent an unintended release of the bearing plate 40 from the spring body 35; the wedge-shaped protrusions 37 (see part section next to FIG. 10*c*) facilitate the locking of the catch and render its release difficult.

The spring properties are imparted to these spring bodies 35 or 35' by the elastic walls of the polygons 38 and 38' with their tips 38.2 and 38.2' respectively which tips are turned outwardly. They are determined by the material constants as well as by their dimensions. In order to achieve a "stiffening" of the spring action in a wide deflection of the spring body 35 or 35' respectively, a tube spring 39 (FIG. 10*a*) is proposed in the region of the tips directed towards each other, or a semi-tube spring 39' (FIG. 10*b*) corresponding to the former and moulded onto the interior side of the spring body head 35.2. This tube spring 39 or 39' respectively causes the spring body head 35.2 at high loading to press against the tube spring and to press letter against the spring body foot 35.1. In this way, the tube spring 39 acts as an independent spring with a different spring load-deflection curve, which now controls a continuing compression, the spring constant increasing accordingly. For a further compression, a proportionately greater force than previously will be required.

The outwardly directed tips 38.2 for the purpose of adjusting the spring constant to the desired values and to catch lateral sheering forces, can be connected via drawn in, bridging, arched support straps 35.3 (FIG. 9*a*); another possibility is by using circle segment recesses 35.4 of these outwardly directed tips 38.2. If recesses 35.4 are proposed at the outwardly directed tips 38.2 or 39.2' respectively of the polygons 38 or 38' respectively, the spring body even when forced together acts like a ball bearing mounting. The bearing plate placed thereon is able to yield in any direction.

Figure 12A:
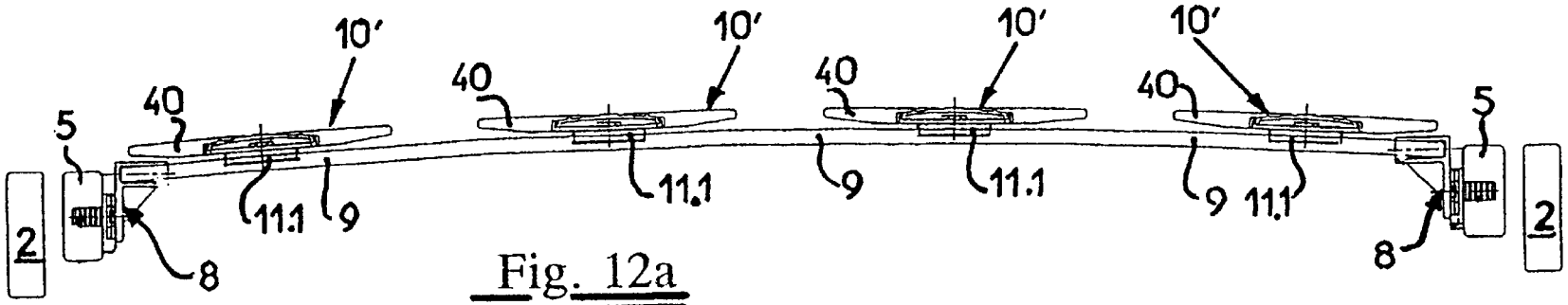
FIG. 12*a*–12*b*: Detail support structure (Longitudinal section).
Figure 12B:
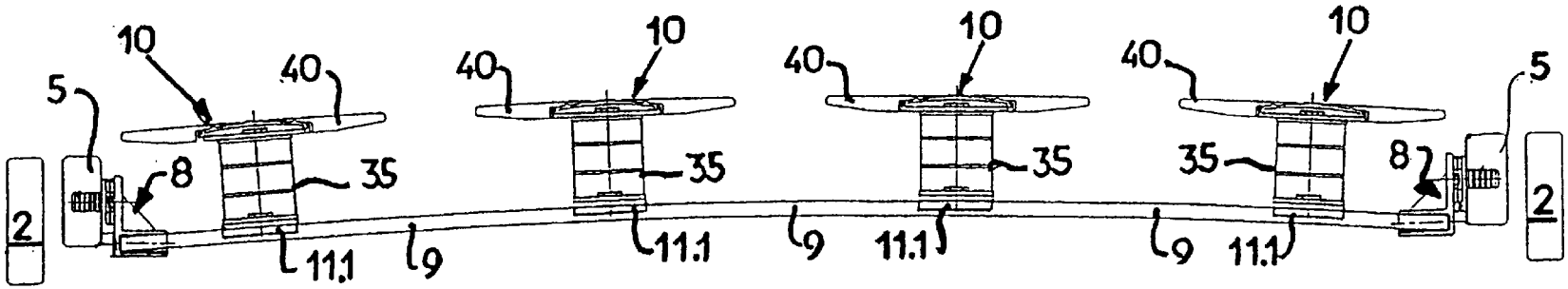

FIGS. 11*a*, 11*b*, 12*a*, 12*b* show a bed system with grid 1 with base frame 2 and two elevated frame parts 3, 5 as well as a head part 7, the side bars of which frame parts have laths 9 which are fastened with dowel pins 8 and are provided with such bearing elements 10 (FIGS. 11*a*, 11*b*), as well as the laths equipped with bearing elements 10 or 10' (FIGS. 12*a*, 12*b*). The elevated frame parts 3 and 5 are hinge-mounted with hinges 4 to the frame 2 or hinge-mounted to each other; the head rest 7 proposed in the frame part 5 is hinged on with a further hinge 6, so that the head rest can also be elevated. Naturally, in this arrangement also the base frame 2 to raise the position of the foot region can be designed to be elevated, if desired. As the side view (with recessed side bars) shows, the laths 9 in the region of the user's buttocks are up to the shoulders equipped with bearing elements 10 with bearing plates 40, which have spring bodies 35 enabling a greater range of spring deflection and thus an increased deflection in the loading region; in the remaining regions, bearing elements 30' without interpositioned spring bodies 35 are provided. In order to provide, in the unloaded state, a planar bearing surface despite this greater spring deflection, the laths with lath holders are fixed by means of known stepped dowel pins 8 to the bars of frames 3, 5 or head rest 7 respectively. In this arrangement only the critical zones are springy, wherein only for these zones the more expensive bearing elements 10 with spring bodies 35 are required.

Figure 13B:
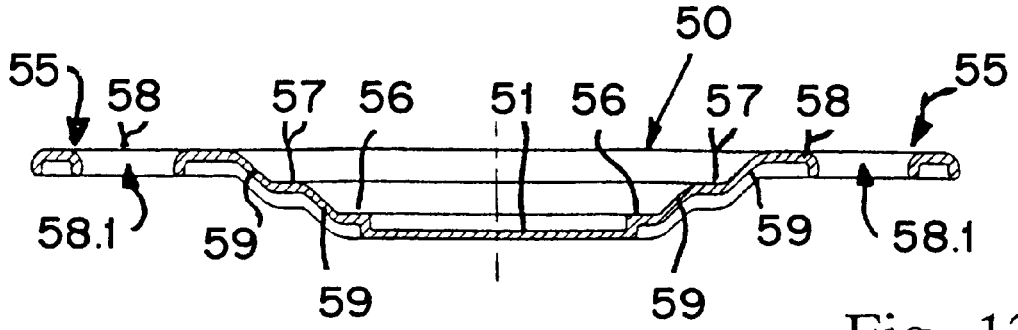
FIG. 13*a*–13*b*: Four-arm bearing plate with stepped radial bridging elements.
Figure 13A:
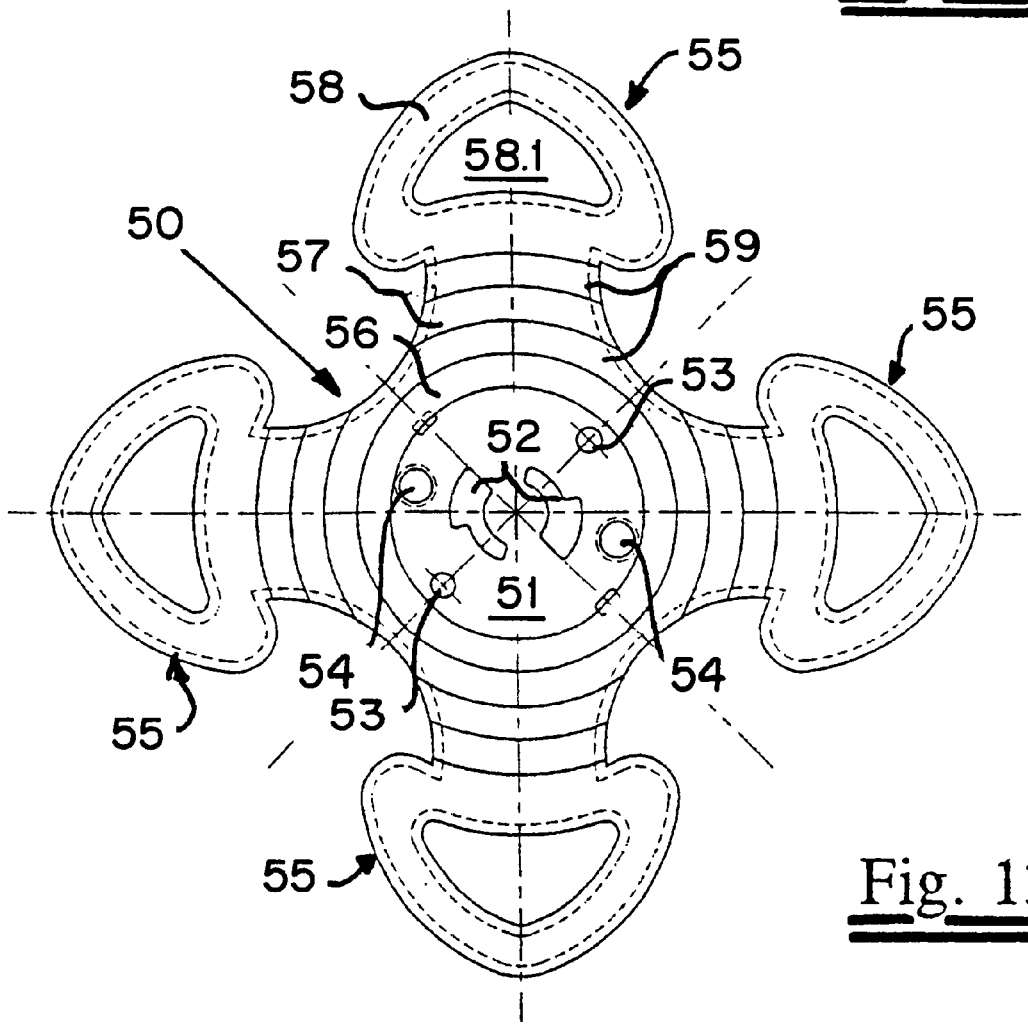

FIGS. 13*a*, 13*b*, 14*a*, 14*b*, 15*a* and 15*b* show differing bearing plates: FIG. 13*a*–13*b* shows a bearing plate 50 with 4 bearing arms 55 at an angular distance of 90°, the inclined radial connectors 59 are stepped to form an intermediate bearing surface 57. The outer bearing surfaces 58 are defined as arrow-shaped and, if arranged appropriately, fit together. The internal bearing surface has been removed so that the central plate 51 with the recesses 52 defining the part can be recognised as part of a twist-lock bayonet catch, which interacts with the lugs provided on the upper face of the central pad and forming the second part of the bayonet catch in such a way that the bearing plate 50 when turned by approximately 90° can be fixed to the central part. Further recesses allow a securing of the bearing plate 50, whereby the recesses are engaged by protrusions on the upper face of the central part—as described above.

Each of these bearing arms 55 has three bearing surfaces 56, 57 and 58 in a stepped arrangement, which are corrected with one another via inclined radial connectors. The inclination of the radial connectors 59 results in a stepped arrangement, wherein the height difference of the steps is determined by the angular position and length of the radial connectors. In order to maintain the elasticity it is essential that the angular position of the surfaces of the connectors is not too steep: the closer the angle is to 90°, the stiffer and more inflexible is the connection of the following higher-positioned bearing surface 56 compared with the central plate 51, or the bearing surface 57 compared with the bearing surface 56, or the bearing surface 58 compared with the bearing surface 57 respectively. In this arrangement, the bearing surfaces 56, 57 or 58 respectively can have further recesses, facilitating a rear ventilation. (see FIG. 8).

Figure 14B:
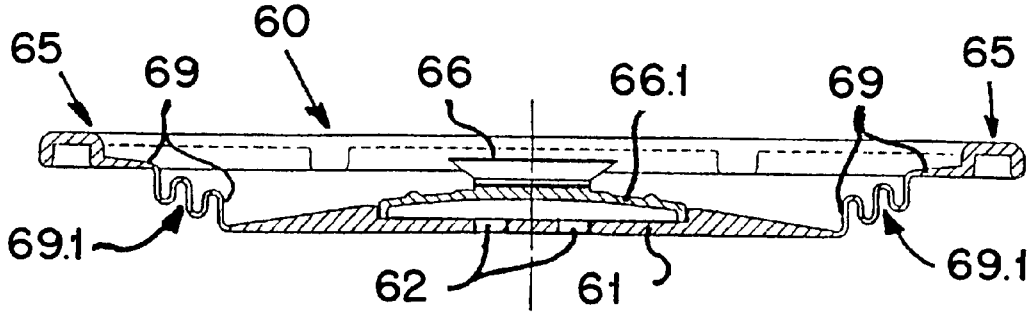
FIG. 14*a*–14*b*: Four-arm bearing plate with undulated spring bridging elements.
Figure 14A:
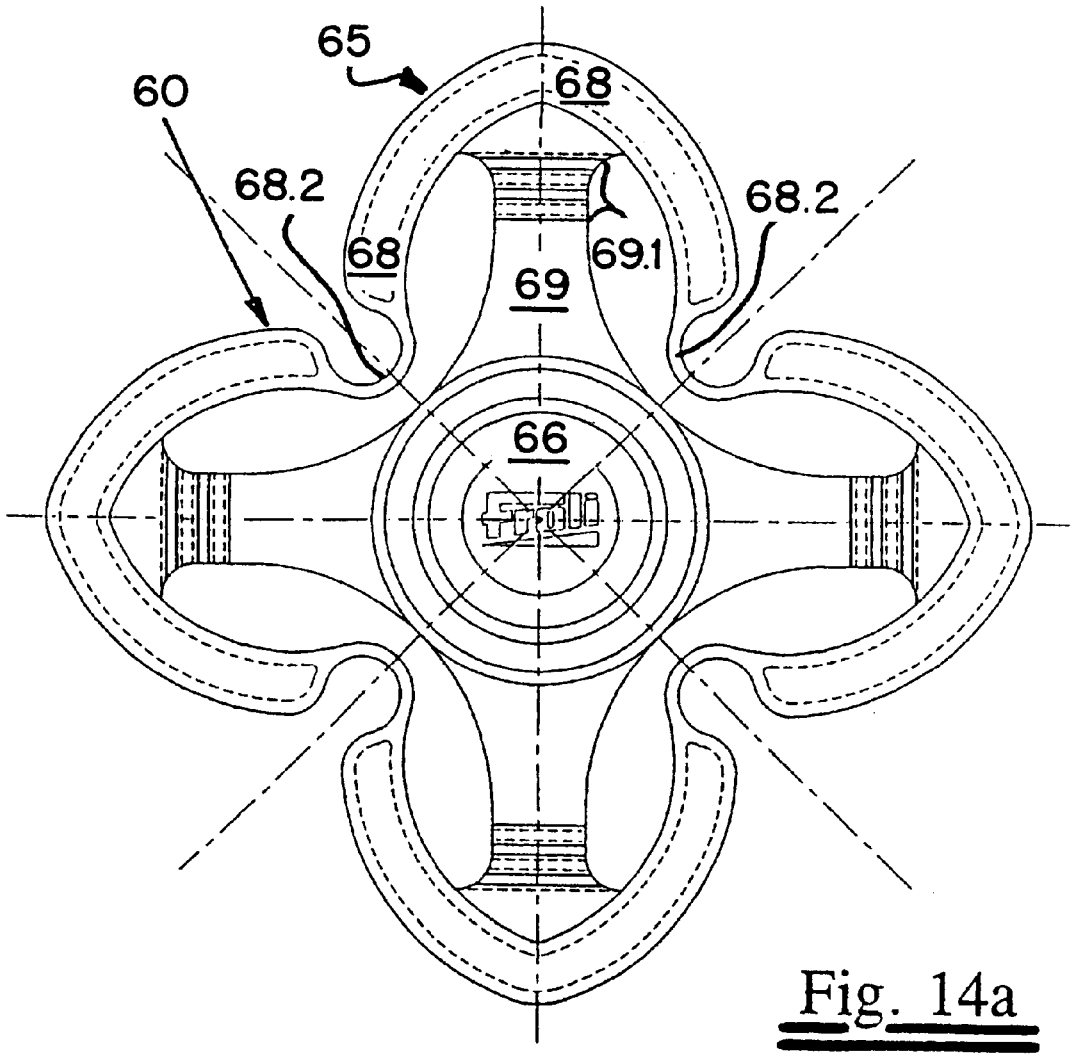

A bearing plate 60 of a different design but also with 4 bearing arms 65 at angular distance of 90° is shown in FIG. 14*a*–14*b*. Here, the four bearing arms 69 are provided with undulated springs 69.1 to improve the spring properties. This bearing plate 60 is identical in its further characteristics to the embodiment shown in FIGS. 13*a*–13*b*. The bearing arms 55 or 65 are arranged diametrically opposite these bearing plates 50 or 60 respectively, without restricting the invention to this arrangement. In the same manner also two bearing arms diametrically opposite each other, or three bearing arms at an angular distance of 120° can be arranged. In these bearing plates, all contours—as can be seen in FIGS. 13*a*–13*b*—are provided with upstanding edges for the purpose of stiffening and greater stability.

Figure 15B:
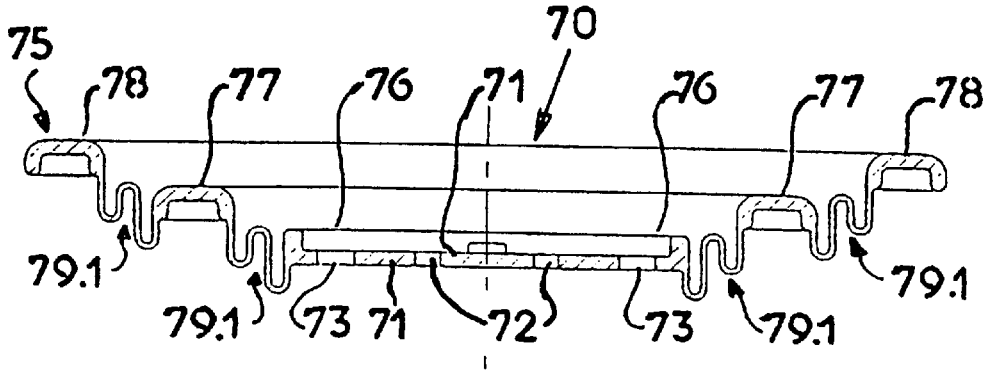
FIG. 15*a*–15*b*: Bearing plate with ring-shaped bearing surface and with undulated spring bridging elements.
Figure 15A:
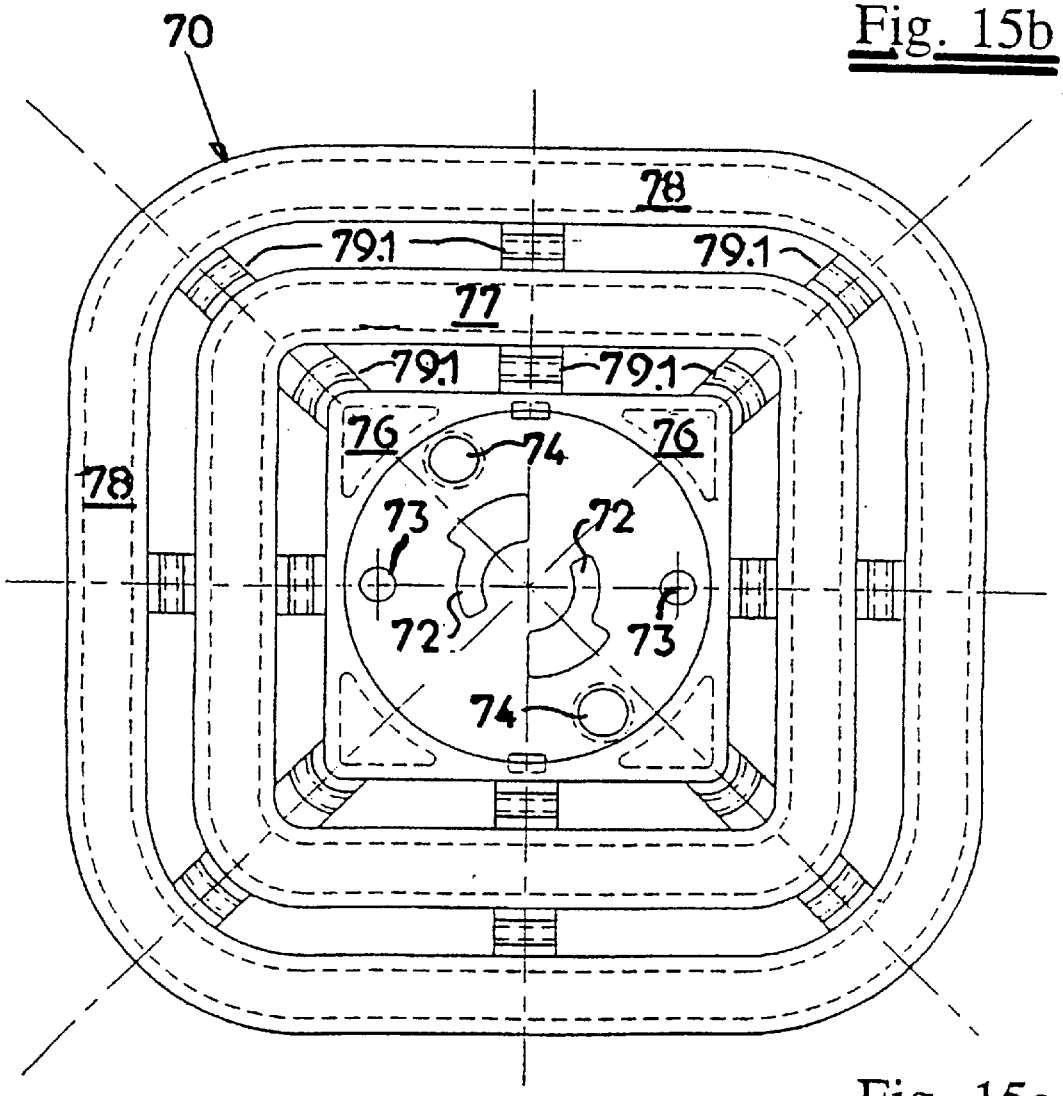

The FIGS. 15*a*–15*b* show a bearing plate 70 with annular bearing surfaces 76, 77, 78, in which arrangement it is understood that besides circular shapes also square or oval shapes can be used. The bearing surfaces 76, 77, 78 are connected via the inclined radial connectors 79 or 79 respectively defined as bridging elements, wherein the reference numbers in the top views are each only marked in one quadrant. Advantageously, also in this case the bridging elements 79 are defined as undulated springs 79.1, the undulations of which—as seen in the section—have flanks which extend essentially parallel. This design of the undulations of these undulated springs allows for an adjustment of the spring constants.

The bearing plates 40 (FIGS. 8*a*–8*c*), 50 (FIGS. 13*a*–13*b*), 60 (FIGS. 14*a*–14*b*) and 70 (FIGS. 15*a*–15*b*) of this type of design have good mould ejection properties during their production as plastic injection moulding parts. In the embodiment example in accordance with the FIGS. 14*a*–14*b*, the interior bearing surface 66 is formed by an insert (66) which is inserted into a corresponding recess of the central plate 61. The edges of the outer bearing surfaces 48, 58, 69 or 78 respectively are designed in such a way that the recesses ensuring a rear ventilation are formed between this edging and the respective bridging element. Coupling links are provided, in order to transfer the movability of the individual bearing surfaces to adjacent bearing surfaces of the same bearing plate.

What is claimed is:

1. Bearing element for upholstery produced as an injection-moulded part made of an elastomer, which bearing element is provided with a base and a bearing plate for holding upholstery, wherein there are disposed between the base and the bearing plate, spring elements extending from the base in the form of leaf springs with a downward range of spring deflection, an outer end of each spring element joined to the bearing plate, there being no fewer than three, and no more than four of the spring elements spaced angularly apart by equal angles, the bearing element, for the compensation of different height levels, provided with compensating means enabling the bearing plate to move to different heights.

2. Bearing element in accordance with claim 1, wherein each spring element includes an undulated spring portion.

3. Bearing element in accordance with claim 1, wherein the leaf-spring-type bearing plate is formed by a plurality of bearing surfaces, wherein adjacent pairs of the bearing surfaces are interconnected by respective spring connectors in such a manner that a compensation is automatically provided for outward movement of the bearing surfaces when deflection of the bearing surfaces occurs.

4. Bearing element in accordance with claim 1, wherein the base is provided with at least one hole which accommodates a fastener for securing the base to a support.

5. Bearing element in accordance with claim 1, wherein for the purpose of fastening the base to a T-shaped holder of a support, the base includes a central hole with at least one flattened side.

6. Bearing element in accordance with claim 1, wherein for the purpose of fastening the base to a support the base has a clamp for interacting with a correspondingly formed part on the support.

7. Bearing element in accordance with claim 1, wherein for the purpose of fastening the base to a support the base has hook-shaped laths.

8. Bearing element for supporting upholstery, the bearing element produced as an injection moulded part made of an elastomer, the bearing element provided with a base and a bearing plate for holding upholstery, wherein there are disposed between the base and the bearing plate at least two spring elements extending from the base in the form of leaf springs with a downward range of spring deflection, the outer end of each leaf spring joined to the bearing plate, the bearing element, for compensation of different height levels of the upholstery being provided with pairs of identically designed locking parts, so that the bearing plate can be releasably attached selectively to the spring body and the base.

9. Bearing element in accordance with claim 8, wherein the locking parts define a bayonet connection.

10. Bearing element in accordance claim 8, wherein the bearing plate is designed as a spring-loaded stepped bearing plate, having bearing surfaces which are connected with one another by spring elements and which are spaced at different heights from one another in such a manner, that innermost ones of the bearing surfaces occupy a lowest level, outermost ones of the bearing surfaces occupy a highest level, and intermediate ones of the bearing surfaces occupy an intermediate level.

11. Bearing element in accordance with claim 10, wherein the bearing plate has at least one outer bearing surface, formed by a circular, oval or rectangular ring, as well as an inner bearing surface, wherein the inner bearing surface is supported directly on a central plate or is formed by letter, wherein bridging elements or radial connectors are provided between the inner bearing surface and the outer bearing surface.

12. Bearing element in accordance with claim 11, wherein the bearing plate has at least two, preferably three or four bearing arms arranged at an angle of 120° or 90° respectively and directed outwardly, the outer ends of which are formed as bearing surfaces, as well as an inner bearing surface, which preferably is supported directly on a central plate or is formed by the latter, and wherein bridging elements or radial connectors are provided between the inner bearing surfaces and the outer bearing surfaces.

13. Bearing element in accordance with claim 11, wherein between the outer bearing surface and the inner bearing surface an intermediate bearing surface is provided, whose height is above that of the inner bearing surface, but below that of the outer bearing surface, which intermediate bearing surface is integrally formed with the bridging elements or radial connectors.

14. Bearing element in accordance with claim 11, wherein at least the outer bearing surface of the bearing plate has bent off edge regions to form a U-profile or C-profile for increased stability.

15. Bearing element in accordance with claim 8, wherein a multi-armed bearing plate having outer bearing surfaces connected via arched links with their respective adjacent bearing surfaces, where the outer bearing surfaces together with the arched links form a closed structure.

16. Bearing element in accordance with claim 8 wherein each of the spring elements comprises a folded structure, the spring elements being interconnected at their lower ends by a foot and at their upper ends by a head, with portions of the locking parts being formed on the head and the foot, respectively, a semi-tube spring integrally formed with an underside of the head and adapted to abut the foot in response to downward flexing of the spring elements.

17. Bearing element in accordance with claim 8 wherein each of the spring elements comprises a folded structure; the spring elements being interconnected at their lower ends by a foot, at their upper ends by a head, and at a location intermediate the upper and lower ends by a semi-tube spring; with portions of the locking parts being formed on the head and the foot, respectively; the semi-tube spring joined to folded portions of the spring elements which project toward one another; wherein each spring element includes a folded portion projecting away from the folded portion of the other spring element and which is provided with a circle segment-shaped recess formed therein, each recess having a width which is shorter than, but equal to, at least one-half of a width of the respective spring element.

18. A bed system for supporting upholstery, comprising a frame having side bars interconnected by slats; bearing elements mounted on the slats and formed of an injection-molded elastomer; each bearing element including a bearing plate, and a base connected to a respective slat; the bearing plates of a first plurality of the bearing elements being connected directly to the respective bases; the bearing plates of a second plurality of the bearing elements being connected to the respective bases by spring elements in the form of leaf springs having a downward range of spring deflection; an outer end of each spring element joined to the bearing plate, there being no fewer than three, and no more than four of the spring elements spaced angularly apart by equal angles; the bearing element, for the compensation of different height levels, provided with compensating means enabling the bearing plate to move to different heights; wherein the second plurality of bearing elements is disposed in a zone of the bed system where buttocks of a user would be disposed; the slats to which the first plurality of bearings are mounted being at a higher elevation than the slats to which the second plurality of bearing elements are mounted, to compensate for the lack of spring elements in the first plurality of bearing elements.

19. A bed system for supporting upholstery, comprising a frame having side bars interconnected by slats; bearing elements mounted on the slats and formed of an injection-molded elastomer; each bearing element including a bearing plates, and a base connected to a respective slat; the bearing plates of a first plurality of the bearing elements being connected directly to the respective bases; the bearing plates of a second plurality of the bearing elements being connected to the respective bases by spring elements in the form of leaf springs having a downward range of spring deflection; the outer end of each leaf spring joined to the bearing plate; the bearing element, for compensation of different height levels of the upholstery being provided with pairs of identically designed locking parts, so that the bearing plate can be releasably attached selectively to the spring body and the base; wherein the second plurality of bearing elements is disposed in a zone of the bed system where buttocks of a user would be disposed; and the rest of the first plurality of bearing elements disposed adjacent an opposite end of the zone; the slats to which the first plurality of bearings are mounted being at a higher elevation than the slats to which the second plurality of bearing elements are mounted, to compensate for the lack of spring elements in the first plurality of bearing elements.

* * * * *